US012702913B2

(12) United States Patent
Arand

(10) Patent No.: US 12,702,913 B2
(45) Date of Patent: Aug. 11, 2026

(54) HEADSET FOR COMBINING VIRTUAL ELEMENTS WITH PHYSICAL ELEMENTS OF A GOLF GAME, AND ITS SYSTEM AND METHOD OF USE

(71) Applicant: Cupojoe Designs LLC, Chicago, IL (US)

(72) Inventor: Joseph F. Arand, Chicago, IL (US)

( * ) Notice: Subject to any disclaimer, the term of this patent is extended or adjusted under 35 U.S.C. 154(b) by 218 days.

(21) Appl. No.: 18/412,501

(22) Filed: Jan. 13, 2024

(65) Prior Publication Data

US 2024/0173609 A1 May 30, 2024

Related U.S. Application Data

(63) Continuation of application No. 17/492,619, filed on Oct. 3, 2021, now Pat. No. 11,904,228.

(60) Provisional application No. 63/138,416, filed on Jan. 16, 2021, provisional application No. 63/087,687, filed on Oct. 5, 2020.

(51) Int. Cl.

| | |
|---|---|
| ***A63B 71/06*** | (2006.01) |
| ***A63B 43/00*** | (2006.01) |
| ***A63B 69/36*** | (2006.01) |
| ***A63B 71/04*** | (2006.01) |

(52) U.S. Cl.

CPC ..... *A63B 71/0622* (2013.01); *A63B 43/004* (2013.01); *A63B 69/3661* (2013.01); *A63B 71/04* (2013.01); *A63B 2071/0638* (2013.01); *A63B 2220/35* (2013.01); *A63B 2225/50* (2013.01)

(58) Field of Classification Search

None

See application file for complete search history.

(56) References Cited

U.S. PATENT DOCUMENTS

| | | | | |
|---|---|---|---|---|
| 3,501,152 | A | 3/1970 | Conklin et al. | |
| 4,836,551 | A | 6/1989 | Lasalle | |
| 5,390,927 | A | 2/1995 | Angelos | |
| 5,855,522 | A | 1/1999 | Bevin | |
| 9,984,587 | B2 | 5/2018 | Shultz | |
| 9,993,712 | B2 | 6/2018 | Coffman | |
| 10,409,363 | B1 * | 9/2019 | Kudirka | A63F 13/211 |
| 10,486,047 | B2 | 11/2019 | Coffman | |
| 10,596,442 | B2 | 3/2020 | Coffman | |
| 10,596,444 | B2 | 3/2020 | Minkovitch | |
| 10,610,734 | B2 | 4/2020 | Claessen et al. | |
| 10,843,056 | B2 | 11/2020 | Rivas | |
| 11,305,172 | B2 | 4/2022 | Coffman | |
| 12,102,900 | B2 * | 10/2024 | Macaulay | A63B 71/02 |
| 2011/0192096 | A1 | 8/2011 | Koberinski et al. | |

(Continued)

FOREIGN PATENT DOCUMENTS

| | | | |
|---|---|---|---|
| KR | 100647498 | B1 | 11/2006 |
| KR | 100912011 | B1 | 8/2009 |

(Continued)

*Primary Examiner* — Ronald Laneau

(57) ABSTRACT

Systems and methods for playing a golf game are disclosed herein. In an embodiment, a headset enabling a golf game having a virtual portion and a physical portion includes a frame and a display screen. The frame is configured to be positioned on a golfer's head. The display screen is configured to display the virtual portion of the golf game to the golfer while the golfer plays the physical portion of the golf game.

20 Claims, 26 Drawing Sheets

(56) References Cited

U.S. PATENT DOCUMENTS

| | | | | |
|---|---|---|---|---|
| 2014/0004969 | A1 | 1/2014 | Jang et al. | |
| 2015/0011279 | A1 | 1/2015 | Koo et al. | |
| 2015/0072746 | A1 | 3/2015 | Jang | |
| 2015/0080142 | A1* | 3/2015 | Kline | A63B 37/0075 473/221 |
| 2015/0094168 | A1 | 4/2015 | Unger, Sr. et al. | |
| 2016/0287967 | A1 | 10/2016 | Baldwin | |
| 2017/0036095 | A1* | 2/2017 | Shultz | G09B 19/0038 |
| 2018/0221747 | A1 | 8/2018 | Coffman | |
| 2019/0022509 | A1 | 1/2019 | Lee et al. | |
| 2019/0099655 | A1 | 4/2019 | Park et al. | |
| 2019/0134506 | A1 | 5/2019 | Gupta et al. | |
| 2019/0168081 | A1 | 6/2019 | Tattersfield | |
| 2019/0255407 | A1* | 8/2019 | Rivas | A63F 13/812 |
| 2020/0206597 | A1 | 7/2020 | Lee et al. | |
| 2020/0330830 | A1 | 10/2020 | Carew-Jones | |
| 2021/0379445 | A1 | 12/2021 | Korpach et al. | |
| 2022/0105416 | A1* | 4/2022 | Arand | A63B 37/0075 |
| 2023/0087604 | A1 | 3/2023 | Lee et al. | |

FOREIGN PATENT DOCUMENTS

| | | | |
|---|---|---|---|
| KR | 100918632 | B1 | 9/2009 |
| KR | 20120009933 | A | 2/2012 |
| KR | 101159676 | B1 | 6/2012 |
| KR | 20150053370 | A | 5/2015 |
| KR | 20170074042 | A | 6/2017 |
| KR | 101868584 | B1 | 6/2018 |
| KR | 20180098924 | A | 9/2018 |
| KR | 20200046777 | A | 5/2020 |
| WO | 2014171765 | A1 | 10/2014 |

* cited by examiner

HEADSET FOR COMBINING VIRTUAL ELEMENTS WITH PHYSICAL ELEMENTS OF A GOLF GAME, AND ITS SYSTEM AND METHOD OF USE

PRIORITY

This application is a continuation of U.S. patent application Ser. No. 17/492,619, filed Oct. 3, 2021, entitled "Systems and Methods for Playing a Golf Game Within Limited Confines," which claims priority to U.S. Provisional Application No. 63/087,687, filed Oct. 5, 2020, and U.S. Provisional Application No. 63/138,416, filed Jan. 16, 2021, both entitled "Systems and Methods for Playing a Golf Game within Limited Confines," the entire contents of each of which is incorporated herein by reference and relied upon.

TECHNICAL FIELD

This disclosure generally relates to systems and methods for playing a golf game. More specifically, the present disclosure relates to systems and methods which combine virtual and physical elements to enable a golfer to play all or a portion of full golf holes, from tee shot to final putt, within the limited confines of a small room or outdoor space.

BACKGROUND

Some people enjoy golf. They may not be good at it, but they still enjoy it. Others seem to hate it, but for some reason they keep playing anyway.

SUMMARY

The present disclosure provides systems and methods for playing a golf game within limited confines. In a first example embodiment, the system includes a wall unit, a floor unit, and a control unit. The wall unit is configured to display a virtual portion of the golf game. The floor unit is configured to enable a physical portion of the golf game. The control unit is programmed to use first data related the virtual portion and second data related to the physical portion to enable a golfer to play a full golf hole.

In a second example embodiment, a system for playing a golf game within limited confines includes a wall unit, a floor unit, a first ball, and a second ball. The wall unit is configured to display a virtual portion of the golf game. The floor unit is configured to enable a physical portion of the golf game. The first ball is configured to be hit by the golfer from the floor unit into the wall unit. The second ball is configured to be putted by the golfer on the floor unit.

In a third example embodiment, a method for playing a golf game within limited confines includes generating a virtual golf hole, calculating a flight path of at least one ball physically hit by the golfer during a first shot related to the virtual golf hole, and instructing the golfer where to place the at least one ball for a second shot related to the virtual golf hole.

In a fourth example embodiment, a method for playing a golf game within limited confines includes generating a virtual golf hole, calculating a landing location related to the virtual golf hole based on of a first shot physically hit by the golfer, and adjusting a putting green surface based on a landing location so that the golfer can physically hit a second shot using the putting green surface.

In a fifth example embodiment, a method for playing a golf game within limited confines includes generating a virtual golf hole, after a golfer physically hits a first ball from a floor unit into a wall unit, calculating a landing location related to the virtual golf hole, and adjusting the floor unit for use with a second ball, which is different from the first ball, based on the landing location.

In a sixth example embodiment, a floor unit for playing a golf game within limited confines includes a hitting portion including at least one hitting surface, a putting portion including a putting green surface, and a control portion configured to adjust the putting green surface.

In a seventh example embodiment, a wall unit for playing a golf game within limited confines includes a display portion configured to display a virtual portion of the golf game, and a sensor portion configured to generate data related to a physical portion of the golf game, the generated data being used to adjust display of the virtual portion.

In an eighth example embodiment, a putting green surface adjuster, which is configured to adjust a surface contour of a putting green surface in combination with other putting green surface adjusters, includes a base portion configured to adjust in height, and a surface supporting portion configured to support the putting green surface, the surface supporting portion further configured to rotate and/or tilt with respect to the base portion.

In a ninth example embodiment, a headset configured for playing a golf game within limited confines includes a frame configured to be positioned on a golfer's head and at least one display screen configured to display a virtual portion of the golf game to the golfer while the golfer plays a physical portion of the golf game.

Other objects, features, aspects and advantages of the systems and methods disclosed herein will be apparent to those skilled in the art from the following detailed description, which taken in conjunction with the annexed drawings, discloses exemplary embodiments of the disclosed systems and methods.

BRIEF DESCRIPTION OF THE DRAWINGS

Referring now to the attached drawings which form a part of this original disclosure.

DETAILED DESCRIPTION

Figure 1:
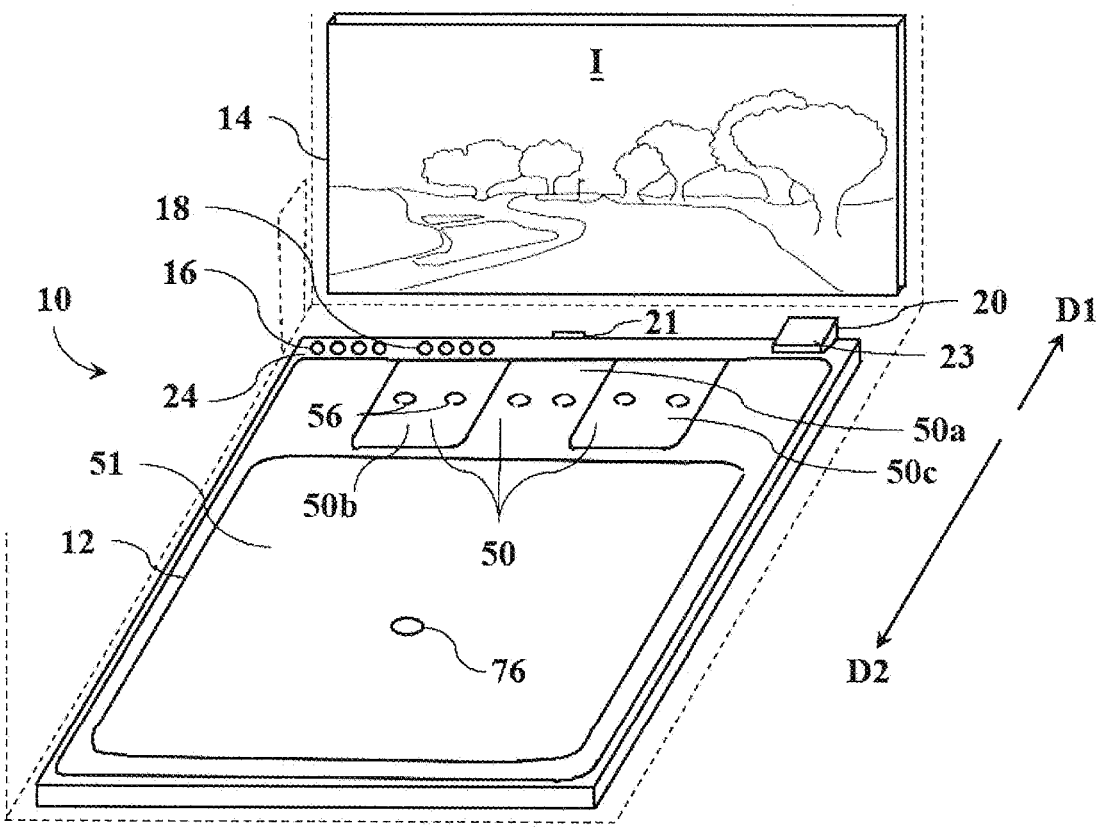
FIG. 1 illustrates a top perspective view of an example embodiment of a system for playing a golf game in accordance with the present disclosure.

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

The present disclosure relates to systems and methods for playing a golf game within limited confines. As used herein, a "golfer" generally refers to a user of the system 10, method 100 and/or headset 200 discussed herein, e.g., a player of a golf game using the system 10, method 100 and/or headset 200; a "golf hole" generally refers to an individual playing area on a golf course, e.g., with a complete golf hole extending from a teeing ground to a putting green; a "final hole" refers to the hole in the putting green which the golf ball enters at the end of each golf hole; a "golf course" generally refers to a group of golf holes, e.g., with a golf course typically including nine, eighteen, or twenty-seven golf holes; a "golf round" generally refers to playing a plurality of golf holes in a predetermined order, e.g., with a golf round typically referring to playing eighteen golf holes at a golf course; a "golf competition" generally refers to competition in which a plurality of players compete against each other by playing one or more golf hole or golf round; and a "golf game" refers to a game played using one or more element of the system 10, method 100 and/or headset 200 discussed herein.

FIGS. 1 to 5 illustrate an example embodiment of a system 10 for playing a golf game in accordance with the present disclosure. In the illustrated embodiment, the system 10 includes a floor unit 12 and a wall unit 14. Using the floor unit 12 and the wall unit 14, a golfer can play a complete golf hole, a complete golf round, and/or a complete golf competition within limited confines, e.g., the confines of the room shown in broken lines in FIG. 1 or a small outdoor space. In the illustrated embodiment, the golfer can play a golf game which combines virtual and physical elements. The wall unit 14 is configured to collect data related to and/or display a virtual portion of the golf game, while the floor unit 12 is configured to enable a physical portion of the golf game and/or collect data related to the virtual portion.

In the illustrated embodiment, the system 10 includes one or more first balls 16 and one or more second balls 18. As explained in more detail below, each first ball 16 is configured for playing the beginning one or more shots of a golf hole, while each second ball 18 is configured for playing the final one or more shots of a golf hole. Thus, using a first ball 16 and a second ball 18, a golfer can play a complete golf hole, from tee shot to final putt, using the floor unit 12 and the wall unit 14. The golfer can further play a plurality of golf holes, thus completing a full golf round and/or a full golf competition using the floor unit 12 and the wall unit 14 in accordance with the methods discussed herein.

In the illustrated embodiment, the floor unit 12 includes a control portion 12*a*, a hitting portion 12*b*, and a putting portion 12*c*. Here, the control portion 12*a* is located closest to the wall unit 14. The hitting portion 12*b* is located between the control portion 12*a* and the putting portion 12*c*. The hitting portion 12*b* is also located closer to the wall unit 14 than the putting portion 12*c*. Those of ordinary skill in the art will recognize from this disclosure that this is an example only and that the locations of one or more of the control portion 12*a*, the hitting portion 12*b*, and/or the putting portion 12*c* can be altered, e.g., based on the layout of the room.

In an embodiment, during a golf hole, a golfer is enabled to physically hit a first ball 16 from the hitting portion 12*b* in the direction D1 towards the wall unit 14 at least once, and the golfer is enabled to physically hit a second ball 18 from the hitting portion 12*b* in the direction D2 towards the putting portion 12*c* at least once. The golfer is also enabled to physically hit a first ball 16 from the hitting portion 12*b* in the direction D1 towards the wall unit 14 at least once, and then physically put on the putting portion 12*c* using a second ball 18 at least once.

In an embodiment, the control portion 12*a* of the floor unit 12 includes one or more of a control center 20, an image projector 21, and/or one or more ball charging station 22. The control center 20 is configured to automatically control the image projector 21 and the one or more ball charging station 22 in addition to the other electrical components described herein and/or any other relevant electrical components.

Figure 6A:
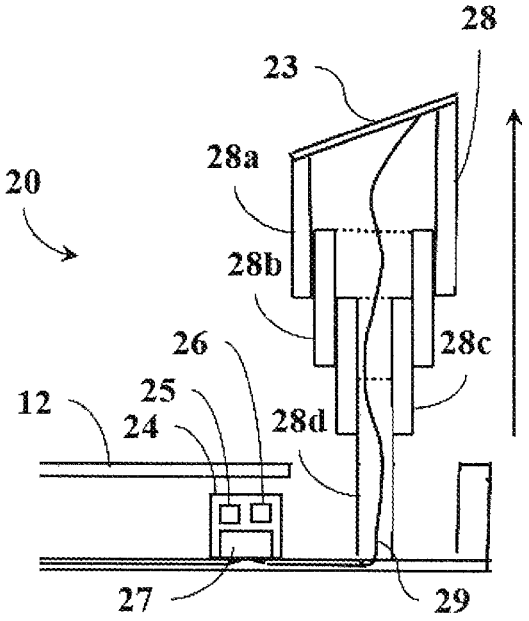
FIG. 6A illustrates a cross-sectional side view of an example embodiment of a control center which can be used with the system of FIGS. 1 to 5, the control center shown in an extended configuration.
Figure 6B:
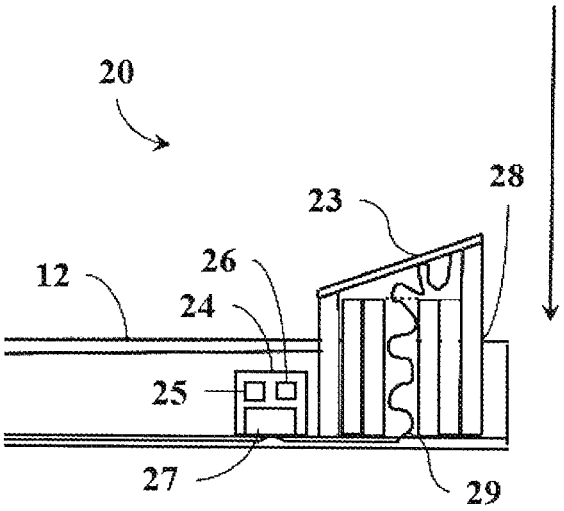
FIG. 6B illustrates a cross-sectional side view of the control center of FIG. 6A in a retracted configuration.

An example embodiment of a control center 20 is illustrated in more detail in FIGS. 6A and 6B. In the illustrated embodiment, the control center 20 includes a user interface 23 and a control unit 24. The user interface 23 can include an input device and a display. In an embodiment, the user interface 23 includes a touch screen, for example, a tablet configured to accept user input on a display screen.

In the illustrated embodiment, the control unit 24 includes a processor 25 and a memory 26. The processor 25 is configured (i.e., programmed) to execute instructions stored on the memory 26 to enable the control unit 24 to control various elements of the system 10 as discussed herein. The processor 25 is further configured to execute instructions stored on the memory 26 to enable the control unit 24 to perform the various steps of method 100 discussed herein. The memory 26 can include a non-transitory, computer-readable medium. The control unit 24 can further include a data transmission device 27 configured to communicate with the rest of the elements of the system 10 discussed herein and/or communicate with an online central server. The data transmission device 27 can include a data bus, a wireless transceiver, and/or any other data transmission mechanism. The data transmission device 27 can be configured for wired or wireless transmission.

As illustrated by FIGS. 6A and 6B, in an embodiment, the user interface 23 is configured to translate between an extended configuration (FIG. 6A) and a retracted configuration (FIG. 6B). In the extended configuration shown in FIG. 6A, the user interface 23 extends upwards for ease of use of a golfer to set up a golf game using the system 10. In the retracted configuration shown in FIG. 6B, the user interface 23 retracts towards the floor unit 12 so that the golfer does not strike the user interface 23 with a ball or club while playing a golf game. In the illustrated embodiment, the control center 20 includes a translation mechanism 28 enabling the user interface 23 to automatically or manually translate upwardly or downwardly. Here, the translation mechanism 28 includes a plurality of sections 28*a*, 28*b*, 28*c*, 28*d* which translate with respect to each other; in doing so, the plurality of sections 28*a*, 28*b*, 28*c*, 28*d* collapse into the floor unit 12. In the illustrated embodiment, the user interface 23 is wired to the control unit 24 via wiring 29 which runs through the translation mechanism; though the user interface 23 and the control unit 24 can also be configured for wireless communication. The control unit 24 can further be wired to the other electrical elements discussed herein, for example, using similar wiring 29 as shown throughout the figures.

Figure 7:
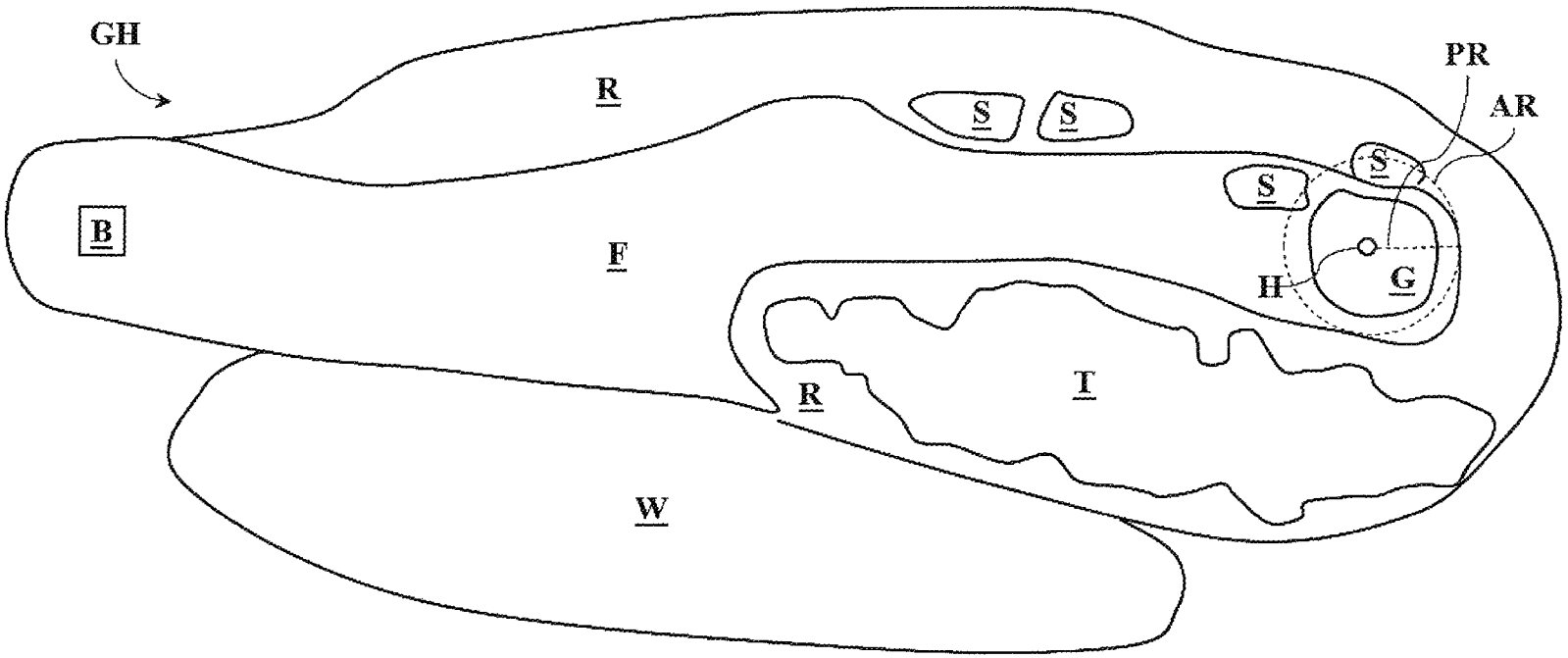
FIG. 7 illustrates an example embodiment of a virtual golf hole which can be generated by the system of FIGS. 1 to 5.

As explained in more detail below, in an embodiment, the control unit 24 is configured to generate one or more virtual golf hole GH to be played by one or more golfer using the system 10. FIG. 7 illustrates an example embodiment of a virtual golf hole GH which has been generated by the control unit 24. As will be understood by most golfers, the virtual golf hole GH includes a fairway F, a rough R, a putting green G including a final hole H, a sand trap S, a water hazard W, a tree hazard T, and a tee box B. These elements represent the typical elements found on a real golf hole, although some of these elements can be omitted for some golf holes, and additional elements can similarly be included for some golf holes.

In an embodiment, the virtual golf hole GH is a randomly created virtual golf hole GH or a prestored virtual golf hole GH. In an embodiment, the memory 26 of the control unit 24 stores a plurality of virtual golf holes GH. The prestored virtual golf holes GH can be modeled after real golf holes on real world golf courses or can be imagined golf holes that do not exist in the real world.

As illustrated in FIG. 7, in an embodiment, the control unit 24 measures an area AR based on a predetermined radius PR from the final hole H. As explained in more detail below, a golfer can use system 10 by physically taking one or more shots with a first ball 16 using the hitting portion 12*b* until the control unit 24 determines a shot to land within the area AR. Once a shot lands within the area AR, the golfer can switch to a second ball 18 and finish the golf hole GH using the putting portion 12*c* of the floor unit 12.

Figure 8:
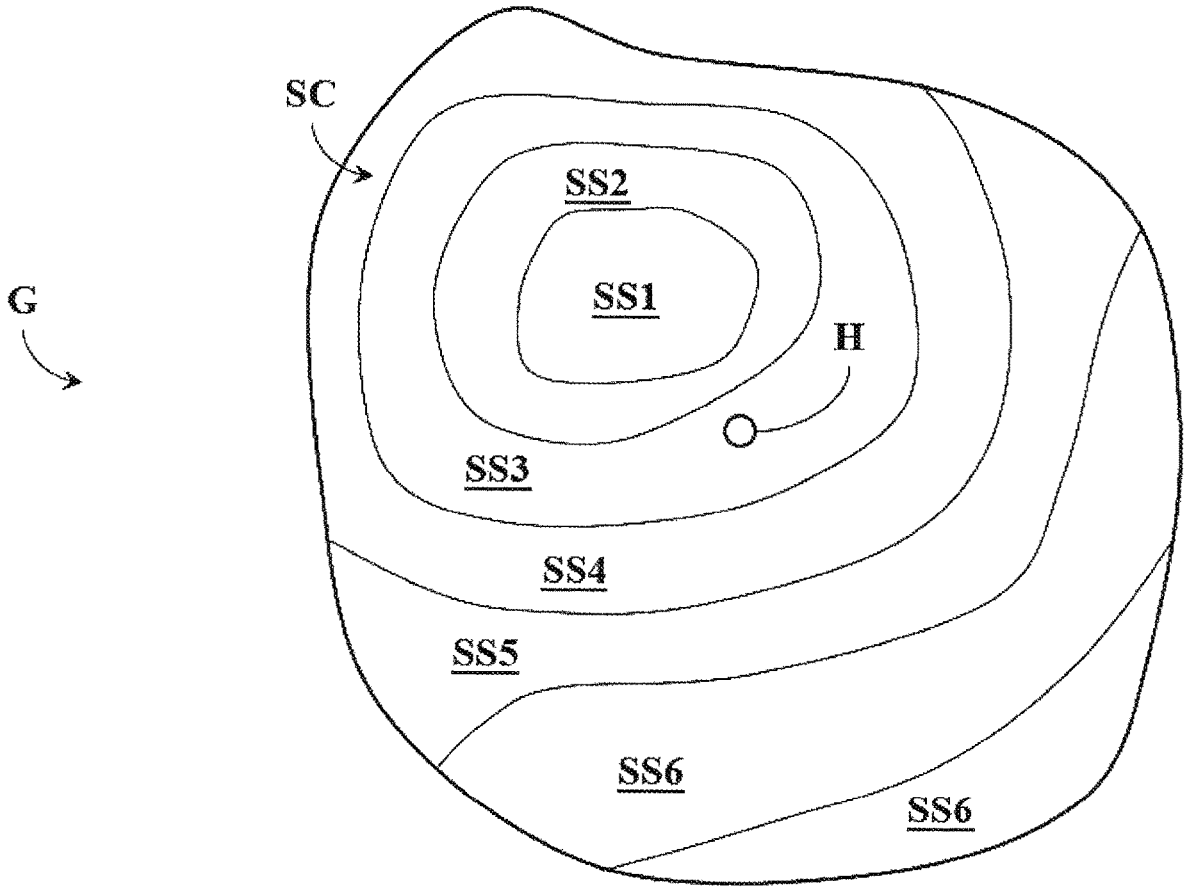
FIG. 8 illustrates an example embodiment of the virtual putting green of the virtual golf hole of FIG. 7.

FIG. 8 shows an example embodiment of the putting green G in more detail. FIG. 8 further illustrates the surface contour SC which the control unit 24 has generated for the putting green G. The surface contour SC is determined by a plurality of surface sections SS1, SS2 . . . SSn, which can have varying heights that result in each golf hole GH having a putting green G with a distinct surface contour SC. As described in more detail below, the putting green portion 12*c* of the floor unit 12 can be adjusted to replicate the virtual surface contour SC of the virtual putting green G of the virtual golf hole GH.

In an embodiment, the image projector 21 is configured to project an image I onto the wall unit 14. The image I can include an image of a virtual golf hole GH currently being played by the golfer in accordance with the methods discussed herein. More specifically, the image I can include a three-dimensional image of the virtual golf hole GH from the perspective of the golfer, e.g., from wherever the golfer's ball is located on the virtual golf hole GH. In the illustrated embodiment, the image projector 21 is located at the front and center of the control portion 12*a* of the floor unit 12, such that the image projector 21 is positioned and arranged to project the image I onto the wall unit 14. In an embodiment, one or more image I can be displayed on a headset 200 worn by the golfer, as discussed in more detail below. In an embodiment, the headset 200 can replace the image projector 21 and/or the wall unit 14.

Figure 9A:
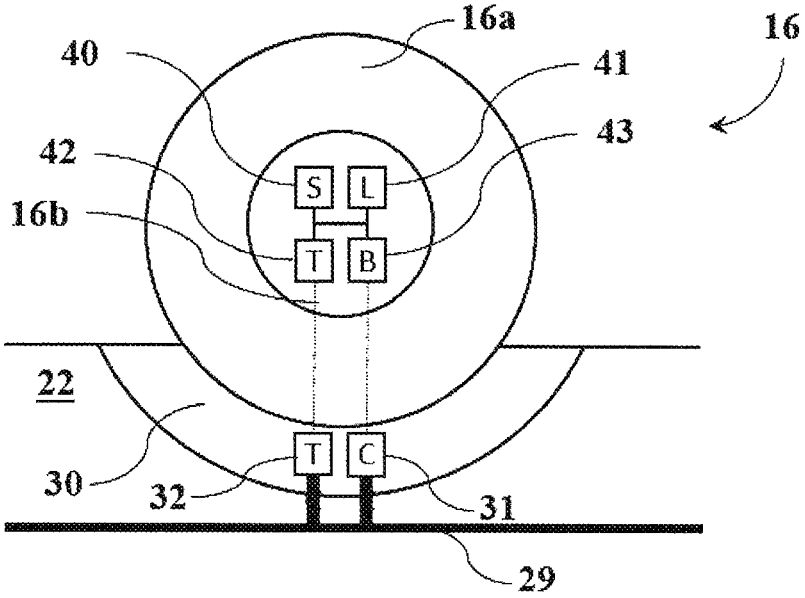
FIG. 9A illustrates a schematic diagram of an example embodiment of a first ball which can be included in or utilized by the system of FIGS. 1 to 5.
Figure 9B:
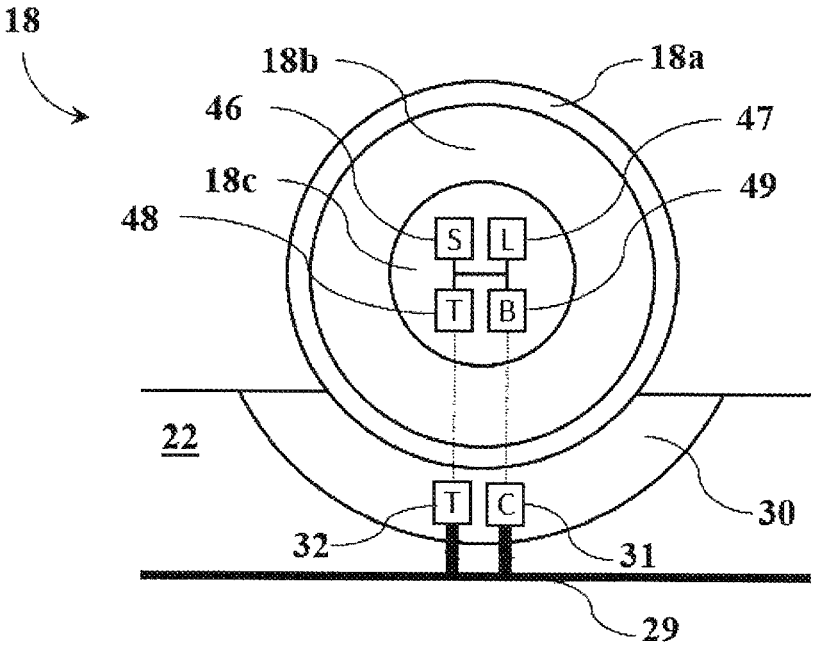
FIG. 9B illustrates a schematic diagram of an example embodiment of a second ball which can be included in or utilized by the system of FIGS. 1 to 5.
Figure 11:
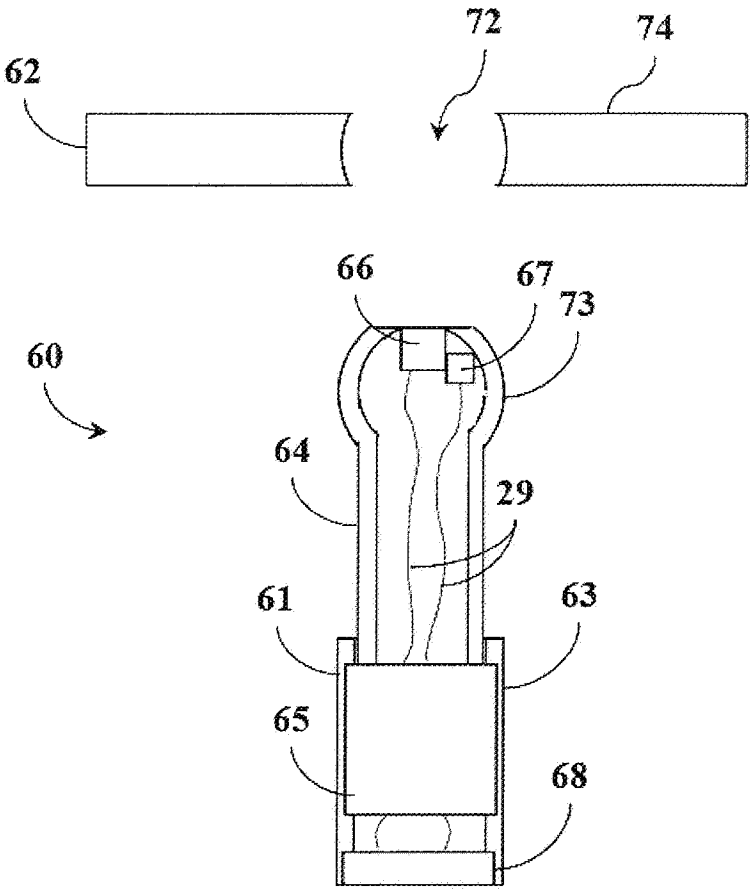
FIG. 11 illustrates a cross-sectional side view of the putting green surface adjuster of FIG. 10, which is taken through line XI-XI in FIG. 10.
Figure 10:
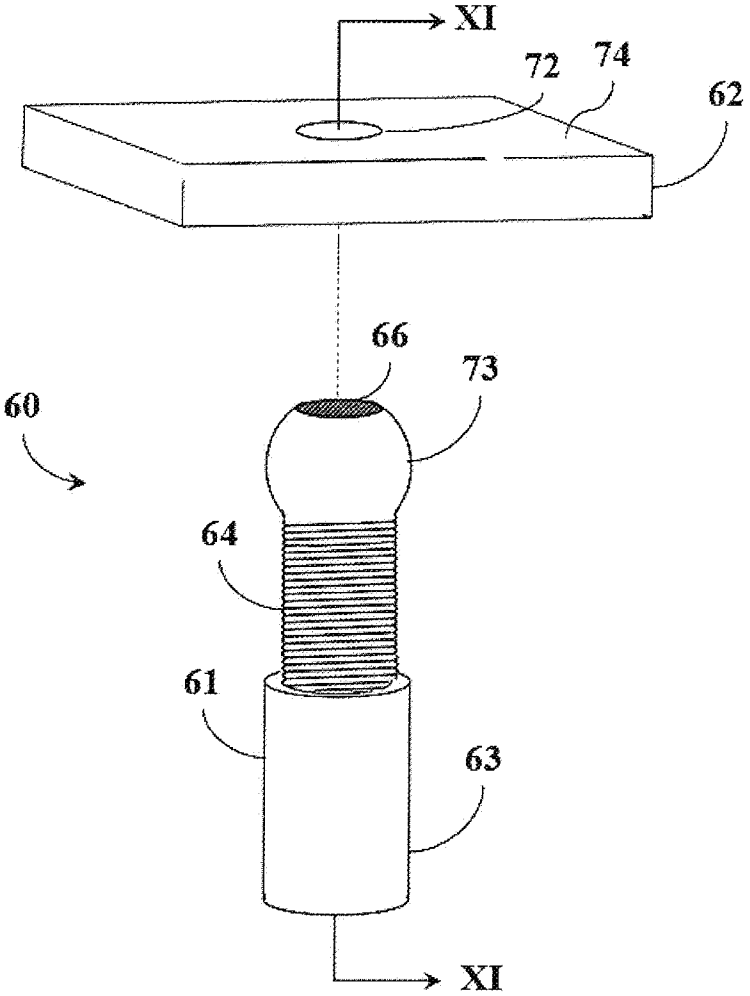
FIG. 10 illustrates an exploded perspective view of a putting green surface adjuster which can be included in the system of FIGS. 1 to 5.
Figure 12:
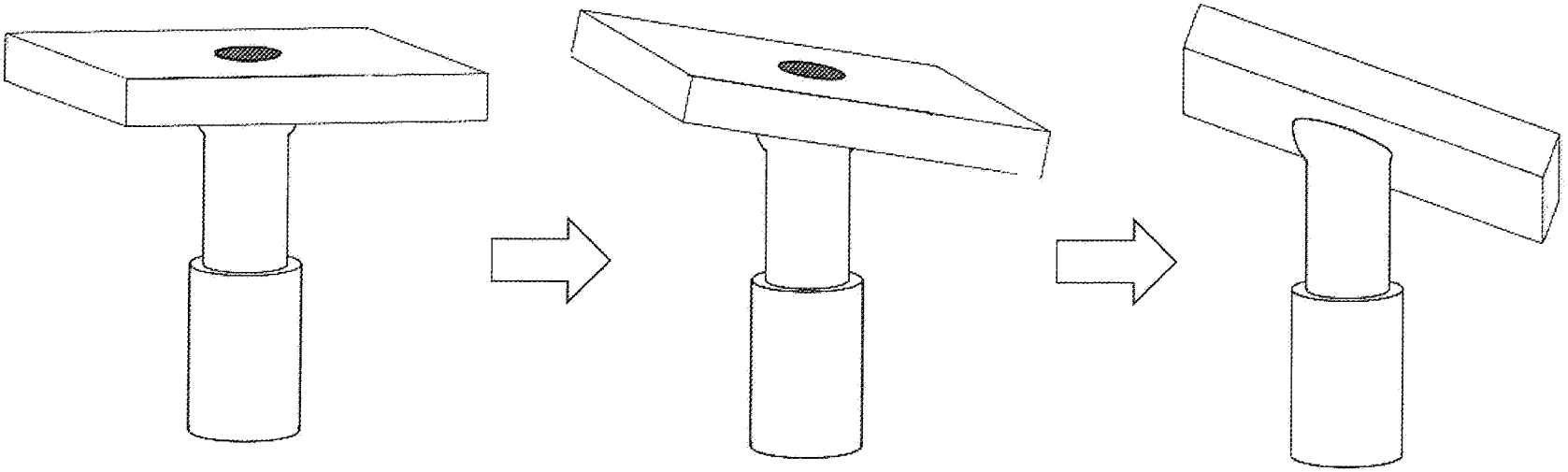
FIG. 12 illustrates the adjustment of the surface supporting portion of the putting green surface adjuster of FIG. 10.
Figure 13:
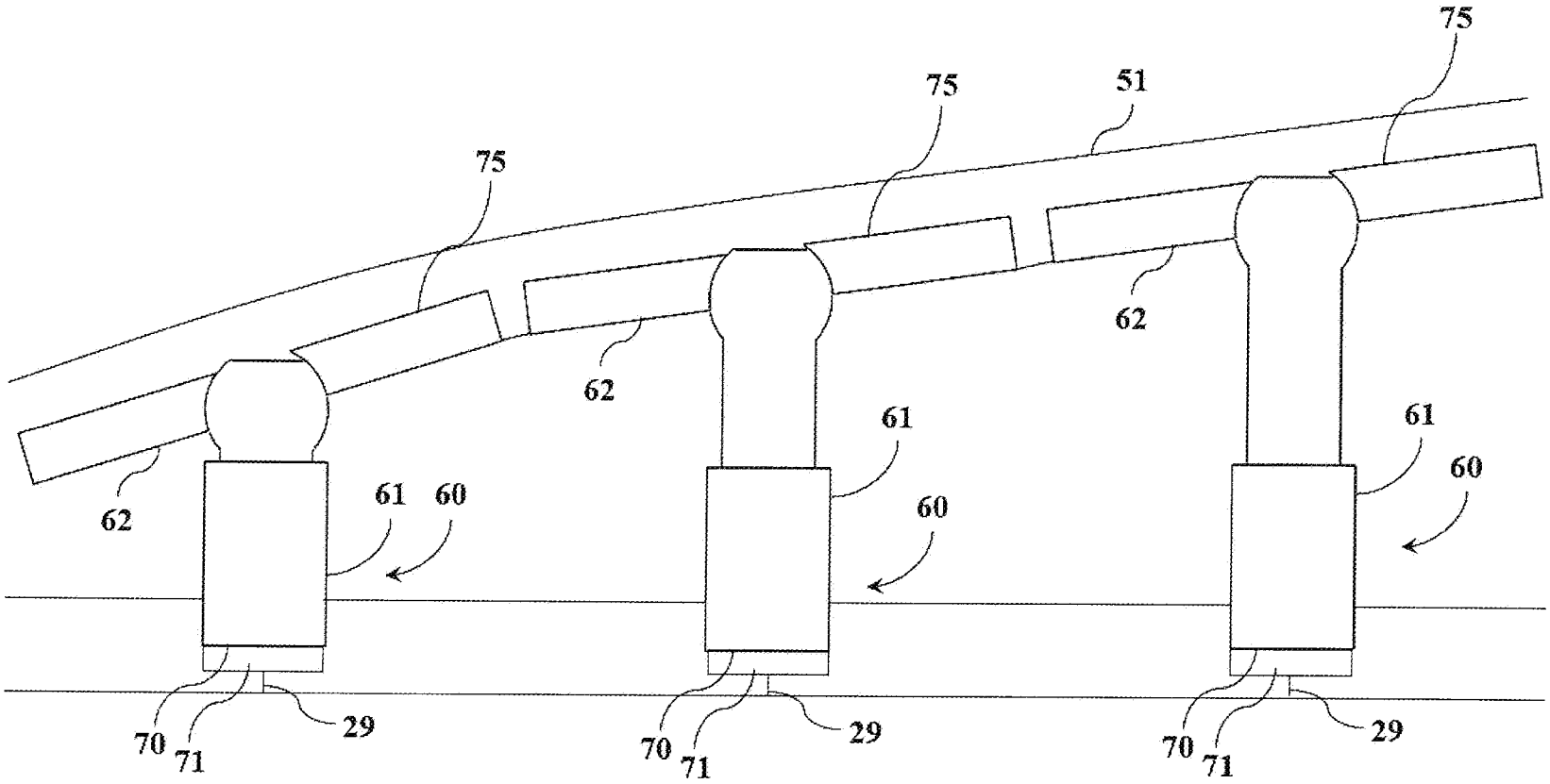
FIG. 13 illustrates an example embodiment of a plurality of putting green surface adjusters creating a unique surface contour for the putting green surface of the system of FIGS. 1 to 5.
Figure 14:
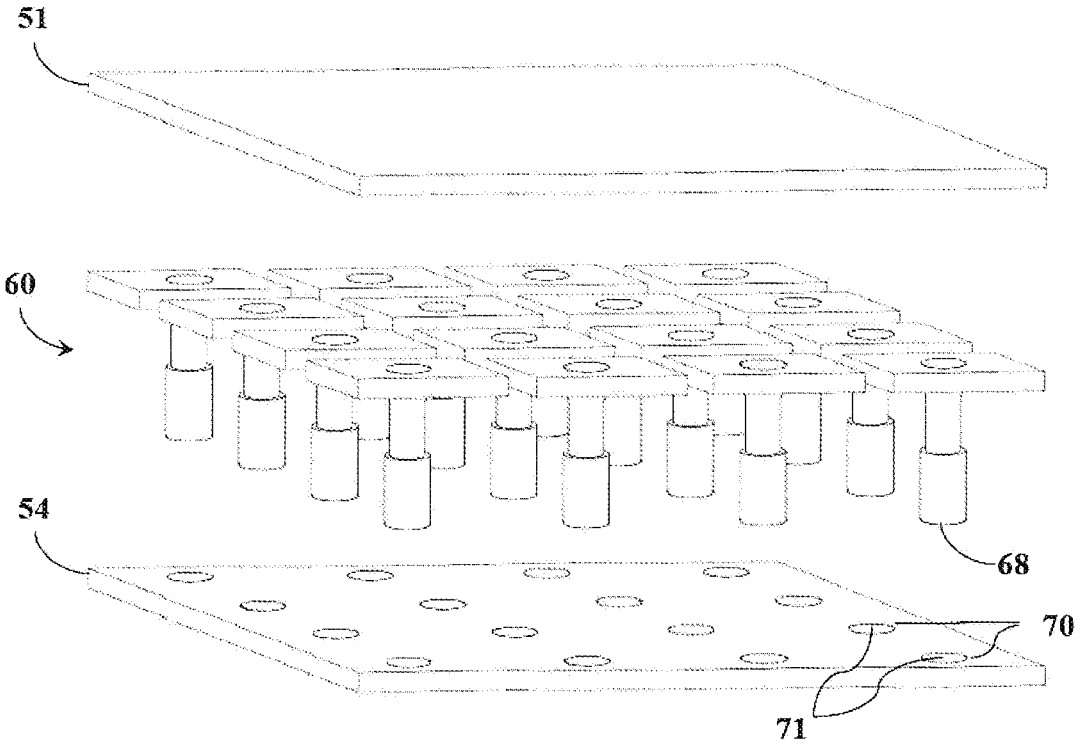
FIG. 14 illustrates an exploded perspective view of a plurality of putting green surface adjusters located between a putting green surface and an electrical layer of the system of FIGS. 1 to 5.

FIG. 9A illustrates an example embodiment of a first ball 16 placed within a first ball station 22, while FIG. 9B illustrates an example embodiment of a second ball 18 placed within a second ball station 22. Each ball charging station 22 can include one or more concave surface 30 configured to receive a first ball 16 and/or a second ball 18. Each ball charging station 22 can further include a wireless battery charger 31 and/or a transceiver 32. In use, the wireless battery charger 31 is configured to provide wireless power to a respective battery of first ball 16 and/or a second ball 18, for example, via electromagnetic inductive or non-radiative charging, loosely-coupled or radiative electromagnetic resonant charging, uncoupled radio frequency wireless charging, and/or other types of wireless charging. The transceiver 32 is configured to communicate with and/or detect one or more elements of a first ball 16 and/or a second ball 18. In an embodiment, the wireless battery charger 31 and/or the transceiver 32 are placed in electronic communication with the control unit 24 via wiring 29 or wirelessly.

In an embodiment, the first ball 16 and the second ball 18 are formed with different materials to reflect their respective functions within the system 10. The first ball 16 is intended to be hit by the golfer into the wall portion 14 using a driver or iron, and can thus be formed to be much softer and lighter than a real golf ball. This way, when the golfer takes a hard swing, the first ball does not damage the system 10 or anything else in the room. The second ball 18 is intended to be physically chipped or putted by the golfer using a wedge or putter, and should thus be formed to have the look and feel of a real golf ball since there should be little risk of powerful wayward shots. It should be understood from this disclosure, however, that certain embodiments can use both a first ball 16 and a second ball 18 which both have the look and feel of a real golf ball, while other certain embodiments can use both a first ball 16 and a second ball 18 which are softer and/or lighter than a real golf ball. It should further be understood from this disclosure that, in some embodiments, a single ball can be used as both the first ball 16 and the second ball 18. In yet another embodiment, a real golf ball can be used as the second ball 18 in accordance with the methods discussed herein.

In the illustrated embodiment of FIG. 9A, the first ball 16 includes a cover layer 16*a* and a core 16*b*. The cover layer 16*a* can include a soft material that will not damage either the wall unit 14 and/or another surface within the room upon contact. The soft material can be, for example, a foam or rubber material. The core 16*b* can include a firmer material that protects the components therein. The firmer material can be, for example, a solid rubber material having a different weight and/or density than the soft material used to form the cover layer 16*a*. Those of ordinary skill in the art will recognize from this disclosure that a first ball 16 can include other layers as well. In a simpler embodiment, the first ball 16 does not require multiple layers and can be formed of a single material.

In an embodiment, within the core 16*b*, the first ball 16 further includes at least one sensor 40, a light 41, a transceiver 42, and/or a battery 43. The at least one sensor 40 can include a spin sensor 40*s*, a first proximity sensor 40*b*, a first speed sensor 40*d*, and/or another sensor 40*x*. The spin sensor 40*s* can be configured to measure a spin rate of the first ball 16 during use of the system 10. In an embodiment, the spin sensor 40*s* includes a gyroscope. The first proximity sensor 40*p* can be configured to emit a signal which can be detected by a corresponding transceiver 32, 55, 67, 77, 82 as described in more detail below. The first speed sensor 40*d* can be configured to measure the speed and/or acceleration of the first ball 16. In an embodiment, the first speed sensor 40*d* includes an accelerometer. In various embodiments, more, less, or no sensors 40 can be used.

In an embodiment, the battery 43 is configured to receive and store the power needed to activate the at least one sensor 40, the light 41, and/or the transceiver 42. The battery 43 can wirelessly receive power from the battery charger 31, for example, via electromagnetic inductive or non-radiative charging, loosely-coupled or radiative electromagnetic resonant charging, uncoupled radio frequency wireless charging, and/or other types of wireless charging. That power can in turn power the transceiver 42 so that the transceiver 42 can send or receive wireless signals with various corresponding transceivers 32, 55, 67, 77, 82 of the system 10 and/or directly with the control unit 24. In an embodiment, the transceiver 42 sends wireless signals regarding data generated by one or more sensor 40. In an embodiment, the transceiver 42 receives wireless signals which cause the light 41 (e.g., an LED) to become illuminated.

In an embodiment, the second ball 18 is configured to look and feel more like a real golf ball in comparison to the first ball 16. This is because the second ball 18 is utilized for chipping and putting and does not strike the wall unit 14 as does the first ball 16. In the illustrated embodiment of FIG. 9B, the second ball 18 includes a cover layer 18*a*, an intermediate layer 18*b*, and a core 18*c*. The cover layer 18*a* can replicate the outer layer of a real golf ball, for example, with a dimpled surface and formed of a hard resin such as urethane. The intermediate layer 18*b* can include, for example, a rubber or elastic material wrapped around the core 18*c*. The core 18*c* can be made, for example, of a synthetic rubber or plastic material. Those of ordinary skill in the art will recognize from this disclosure that a second ball 18 can include other layers as well. In a simpler embodiment, the second ball 18 does not require multiple layers and can be formed of a single material. Any of the features of the first ball 16 can be included in the second ball 18, and vice versa.

In an embodiment, within the core 18*c*, the second ball 18 further includes at least one sensor 46, a light 47, a transceiver 48, and a battery 49. The at least one sensor 46 can include a spin sensor 46*s*, a second proximity sensor 46*p*, a second speed sensor 46*d*, and/or another sensor 46*x*. The spin sensor 46*s* can be configured to measure a spin rate of the second ball 18 during use of the system 10. In an embodiment, the spin sensor 46*s* includes a gyroscope. The second proximity sensor 46*p* can be configured to emit a signal which can be detected by a corresponding transceiver 32, 55, 67, 77, 82 as described in more detail below. The second speed sensor 46*d* can be configured to measure the speed and/or acceleration of the second ball 18 and can be used to provide feedback to the golfer regarding the golfer's shots taken with the second ball 18. In an embodiment, the second speed sensor 46*d* includes an accelerometer. In various embodiments, more, less, or no sensors 46 can be used. In an embodiment, a real golf ball can be used as the second ball 18.

In an embodiment, the battery 49 is configured to receive and store the power needed to activate the at least one sensor 46, the light 47, and/or the transceiver 48. The battery 49 can wirelessly receive power from the battery charger 31, for example, via electromagnetic inductive or non-radiative charging, loosely-coupled or radiative electromagnetic resonant charging, uncoupled radio frequency wireless charging, and/or other types of wireless charging. That power can in turn power the transceiver 48 so that the transceiver 48 can send or receive wireless signals with various corresponding transceivers 32, 55, 67, 77, 82 of the system 10 and/or directly with the control unit 24. In an embodiment, the transceiver 48 sends wireless signals regarding data generated by one or more sensor 46. In an embodiment, the transceiver 48 receives wireless signals which cause the light 47 (e.g., an LED) to become illuminated.

In an embodiment, the hitting portion 12*b* of the floor unit 12 includes one or more hitting surface 50, while the putting portion 12*c* of the floor unit 12 can include a putting green surface 51. During a golf hole, a golfer can hit a first ball 16 from one or more hitting surface 50 in the direction D1 towards the wall unit 14 at least once, and the golfer can hit a second ball 18 from one or more hitting surface 50 in the direction D2 towards the putting green surface 51 at least once. The golfer can also hit a first ball 16 from one or more hitting surface 50 in the direction D1 towards the wall unit 14 at least once, and then put on the putting green surface 51 using a second ball 18 at least once.

In an embodiment, the one or more hitting surface 50 includes a plurality of hitting surfaces 50. In the illustrated embodiment, the one or more hitting surface 50 includes a first surface 50*a*, a second surface 50*b*, and a third surface 50*c*. As used herein, the first surface 50*a* is also referred to as the fairway surface 50*a*, the second surface 50*b* is also referred to as the rough surface 50*b*, and the third surface 50*c* is also referred to as the sand surface 50*c*. The purpose of these hitting surfaces 50 is to simulate the fairway, rough, and sand surfaces that a golfer would most frequently encounter on a real golf course. Additional or different hitting surfaces 50 can also be used. Use of these hitting surfaces 50 is discussed in more detail below.

In an embodiment, each hitting surface 50 includes at least one layer. In the illustrated embodiment, each hitting surface 50 includes a surface layer 52 and a support layer 53, which are positioned above an electrical layer 54 which can include wiring which electrically connects any electrical component of the hitting portion 12*b* to the control center 20. In the illustrated embodiment, for example, one or more transceiver 55 is located within each hitting zone 50. The transceivers 55 can electrically communicate with the control unit 24 via wiring 29 or wirelessly.

In an embodiment, the fairway surface 50*a* includes a surface layer 52*a* and a support layer 53*a*. The surface layer 52*a* can include a thin surface which replicates the texture of a real fairway on a golf course. For example, the surface layer 52*a* can be formed with an artificial grass having a length of about 0.3 to 0.5 inches. In an embodiment, the surface layer 52*a* can include natural grass. The support layer 53*a* can include a thicker surface which replicates the firmness of a real fairway on a golf course. For example, the support layer 53*a* can include a foam, rubber or plastic material which replicates the firmness of the soil of a real fairway on a golf course. In a simpler embodiment, the fairway surface 50*a* does not require multiple layers and can be formed of a single material.

In an embodiment, the rough surface 50*b* includes a surface layer 52*b* and a support layer 53*b*. The surface layer 52*b* can include a thin surface which replicates the texture of a real rough on a golf course. For example, the surface layer 52*b* can be formed with an artificial grass having a length of about 1.0 to 1.3 inches. In an embodiment, the surface layer 52*b* can include natural grass. The support layer 53*b* can include a thicker surface which replicates the firmness of a real rough on a golf course. For example, the support layer 53*b* can include a foam, rubber or plastic material which replicates the firmness of the soil of a real rough on a golf course. In a simpler embodiment, the rough surface 50*b* does not require multiple layers and can be formed of a single material.

In an embodiment, the sand surface 50*c* includes a surface layer 52*c* and a support layer 53*c*. The surface layer 52*c* can include a thin surface which replicates the texture of a real sand trap on a golf course. The support layer 53*c* can include a thicker surface which replicates the firmness of a real sand trap on a golf course. In an embodiment, the surface layer 52*c* can include sand. In an embodiment, the support layer 53*c* can include sand. In another embodiment, the support layer 53*c* can include a foam, rubber or plastic material which replicates the firmness of the sand of a real sand trap on a golf course. In a simpler embodiment, the sand surface 50*c* does not require multiple layers and can be formed of a single material.

In an embodiment, a fourth surface 50*d* includes a surface layer 52*d* and a support layer 53*d* and/or a fifth surface 50*e* includes a surface layer 52*e* and a support layer 53*e*. The fourth surface 50*d* and/or the fifth surface 50*e* can be used to replicate additional surfaces that a golfer might encounter on a typical golf course. Alternatively, the fourth surface 50*d* and/or the fifth surface 50*e* can be formed in the same way as the other surfaces 50 discussed herein. In an embodiment, the fourth surface 50*d* and/or the fifth surface 50*e* can be equipped with golf bag stands to hold the golf bags of one or more golfers using the system 10. One advantage of the system 10 and/or method 100 discussed herein is that specialized golf clubs are not required and the golfer can use his or her own golf clubs to play a golf game. In an embodiment, however, specialized golf clubs can be configured to operate in conjunction with the system 10 and/or method 100. The fourth surface 50*d* and/or the fifth surface 50*e* can further provide standing room for other golfers while a golfer is hitting a ball.

In an embodiment, each surface 50 includes at least one striking zone 56. In the illustrated embodiment, each of the fairway surface 50*a*, the rough surface 50*b* and the sand surface 50*c* includes a left striking zone 56L for a left-handed golfer and a right striking zone 56R for a right-handed golfer. The left striking zone 56L is located on the left side of its respective surface 50 from the perspective of FIG. 2, which enables a left-handed golfer to stand entirely within that respective surface 50 when hitting a first ball 16 towards the wall unit 14. The right striking zone 56R is located on the right side of its respective surface 50 from the perspective of FIG. 2, which enables a right-handed golfer to stand entirely within that respective surface 50 when hitting a first ball 16 towards the wall unit 14. When hitting towards the putting green surface 51, however, the "left" and "right" zones are switched.

Figure 2:
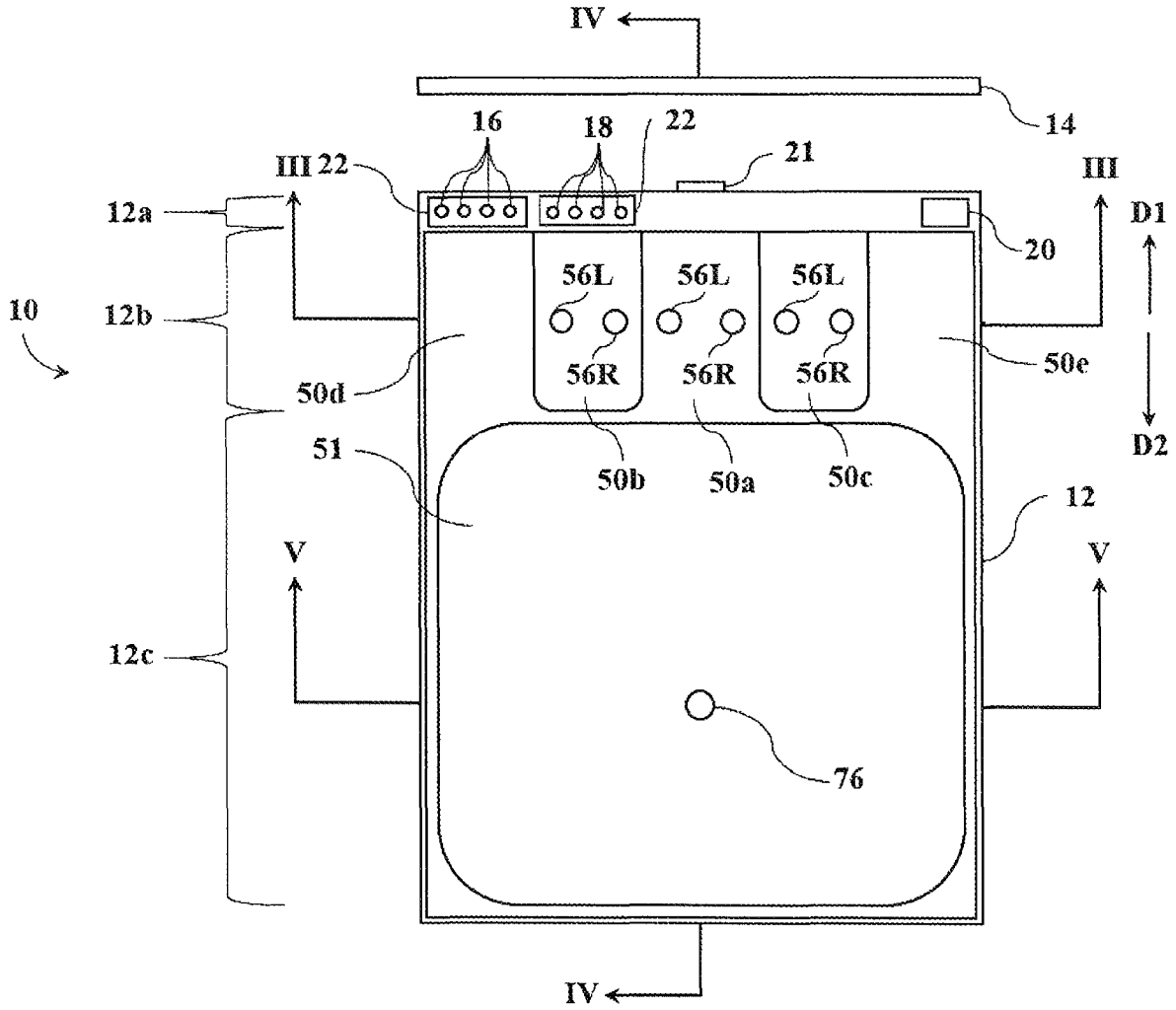
FIG. 2 illustrates a top plan view of the system of FIG. 1.
Figure 3:
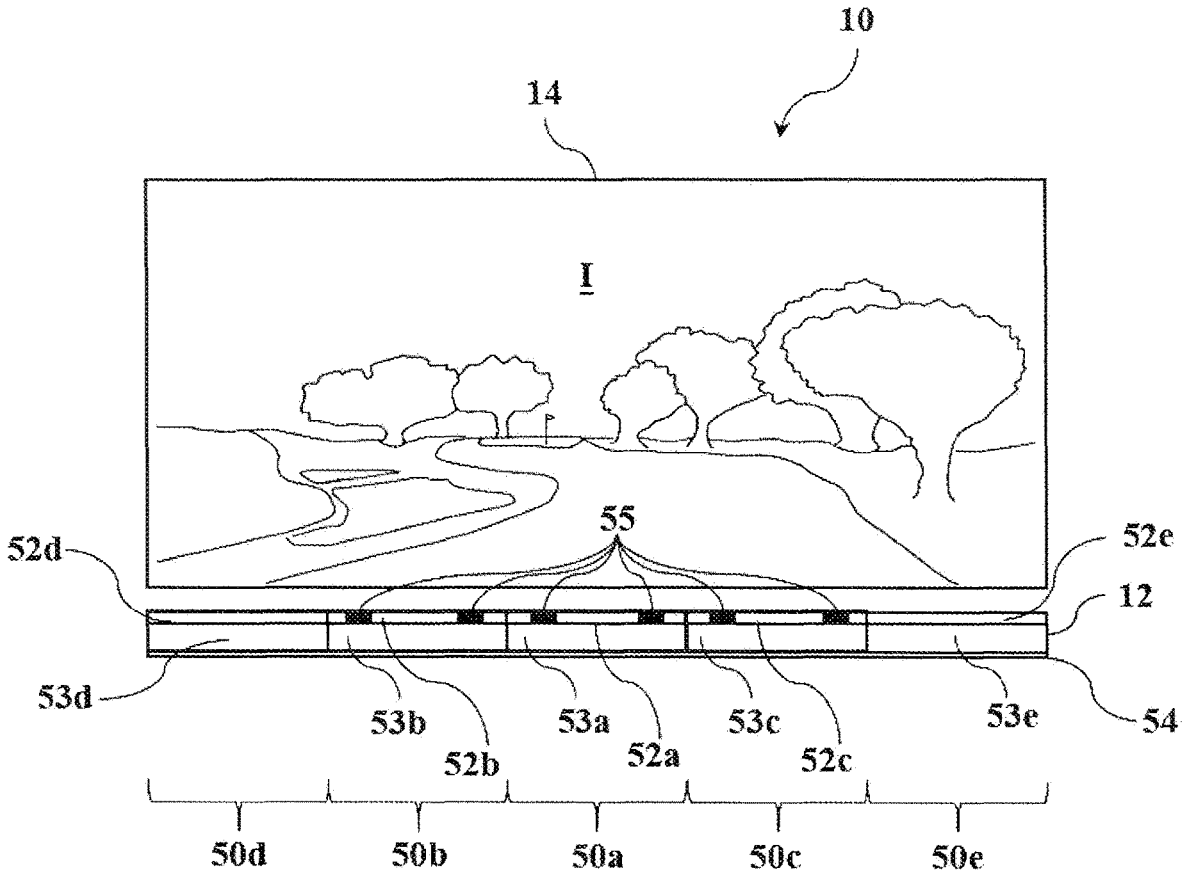
FIG. 3 illustrates a cross-sectional side view of the system of FIGS. 1 and 2, which is taken through line III-III in FIG. 2.

In FIG. 2, only two striking zones 56 are shown within each of the first surface 50*a*, the second surface 50*b* and the third surface 50*c*. It should be understood from this disclosure, however, that each zone can include more or less striking zones 56. For example, striking zones can be located at different distances from the wall unit 14 and/or at different distances from the left and right sides of their respective surface 50. In an embodiment, one or more surface 50 can include a grid of striking zones 56, such that much or all of the surface area of the surface 50 includes a striking zone 56.

As illustrated in FIG. 2, in an embodiment, the floor unit 12 includes a transceiver 55 located at each striking zone 56. Each transceiver 55 can be configured to detect the presence of the first proximity sensor 40*p* of the first ball 16 when the first ball 16 is placed within that respective striking zone 56. Each transceiver 55 can also be configured to detect the presence of the second proximity sensor 46*p* of the second ball 18 when the second ball 18 is placed within that respective striking zone 56. Thus, the control unit 24 can determine when a first ball 16 or a second ball 18 has been placed within a striking zone 56. Each transceiver 55 can also be configured to send and/or receive wireless signals with a first transceiver 42 of a first ball and/or a second transceiver 48 of a second ball 18, e.g., to cause a light 41 or a light 47 to illuminate when a first ball 16 or second ball 18 is placed within a striking zone 56.

In an embodiment, the putting portion 12*c* of the floor unit 12 includes a plurality of putting green surface adjusters 60 located beneath the putting green surface 51. In use, each of the putting green surface adjusters 60 can be independently controlled by the control unit 24 to be raised or lowered, thus adjusting the surface contour of the putting green surface 51.

The putting green surface adjusters 60 can be formed in a variety of ways. An example embodiment of a putting green surface adjuster 60 is shown in more detail with reference to FIGS. 10 to 14 below. In the illustrated embodiment, the putting green surface adjuster 60 includes a base portion 61 and a surface supporting portion 62. In use, the putting green surface 51 sits on top of the surface supporting portions 62 of a plurality of putting green surface adjusters 60, and the control unit 24 adjusts the height of the base portion 61 of each putting green surface adjuster 60 to adjust the surface contour of the putting green surface 51.

In an embodiment, the base portion 61 includes a bottom part 63 and a top part 64. The bottom part 63 can be or include an actuator 65 that raises or lowers the top part 64. In an embodiment, the bottom part 63 can include an actuator 65 which raises or lowers the top part 64 by rotating the top part 64 around the vertical center axis thereof. In an embodiment, the top part 64 includes a threaded outer surface which causes it to be raised or lowered when rotating within the bottom part 63. In another embodiment, the bottom part 63 can include an actuator 65 which translates the top part 64 upward or downward without rotating the top part 64. The actuator 65 can be, for example, a linear actuator.

In the illustrated embodiment, the top part 64 includes a light 66 and/or a transceiver 67, which are discussed in more detail below. The light 66, the transceiver 67, and/or the actuator 65 can be placed in electrical communication with an electrical contact 68, which enables the control unit 24 to independently provide power to and/or control each component. Alternatively, the control unit 24 can wirelessly control these components.

As illustrated in FIGS. 4, 5, 13 and 14, in an embodiment, each base portion 61 is configured to be positioned within a corresponding aperture 70 in the electrical layer 53. Each aperture 70 can include an electrical contact 71 which is placed in communication with an electrical contact 68, thus placing the components of that putting green surface adjuster 60 in electrical communication with the control unit 24, e.g., via wiring 29 through electrical later 54 or wirelessly. By forming the electrical layer 53 and/or putting green surface adjuster 60 in this way, a malfunctioning putting green surface adjuster 60 can be quickly and easily replaced by simply removing it and inserting a new putting green surface adjuster 60 in its place. In this way, the control unit 24 can control the location of the putting green surface adjuster 60 as opposed to the putting green surface adjuster 60 itself, this allowing putting green surface adjusters 60 to be moved and/or replaced.

In an embodiment, the surface supporting portion 62 includes an aperture 72 in a center thereof, wherein the surface supporting portion 62 surrounding the aperture 72 forms a ball joint with a bulbous portion 73 of the base portion 61. In this way, the surface supporting portion 62 can rotate and/or tilt freely with respect to the base portion 61. This enables the surface supporting portion 62 to remain rotationally stationary as it is raised or lowered while the top part 64 rotates within the bottom part 63. This also enables the surface supporting portion 62 to support the putting green surface at various angles, such that a plurality of putting green surface adjusters 60 can drastically alter the contour of the putting green surface 51 in the x, y and z directions. In this way, the tilt of the surface supporting portion 62 adjusts to match the relative positioning of surrounding surface supporting portions 62, thus giving the putting green surface 51 a smooth feel even when different putting green surface adjusters 60 are located at different heights. The aperture 72 can further enable the light 66 to shine therethrough. The surface supporting portion 62 can further include a flat upper surface 74 to support the putting green surface 51.

Figure 4:
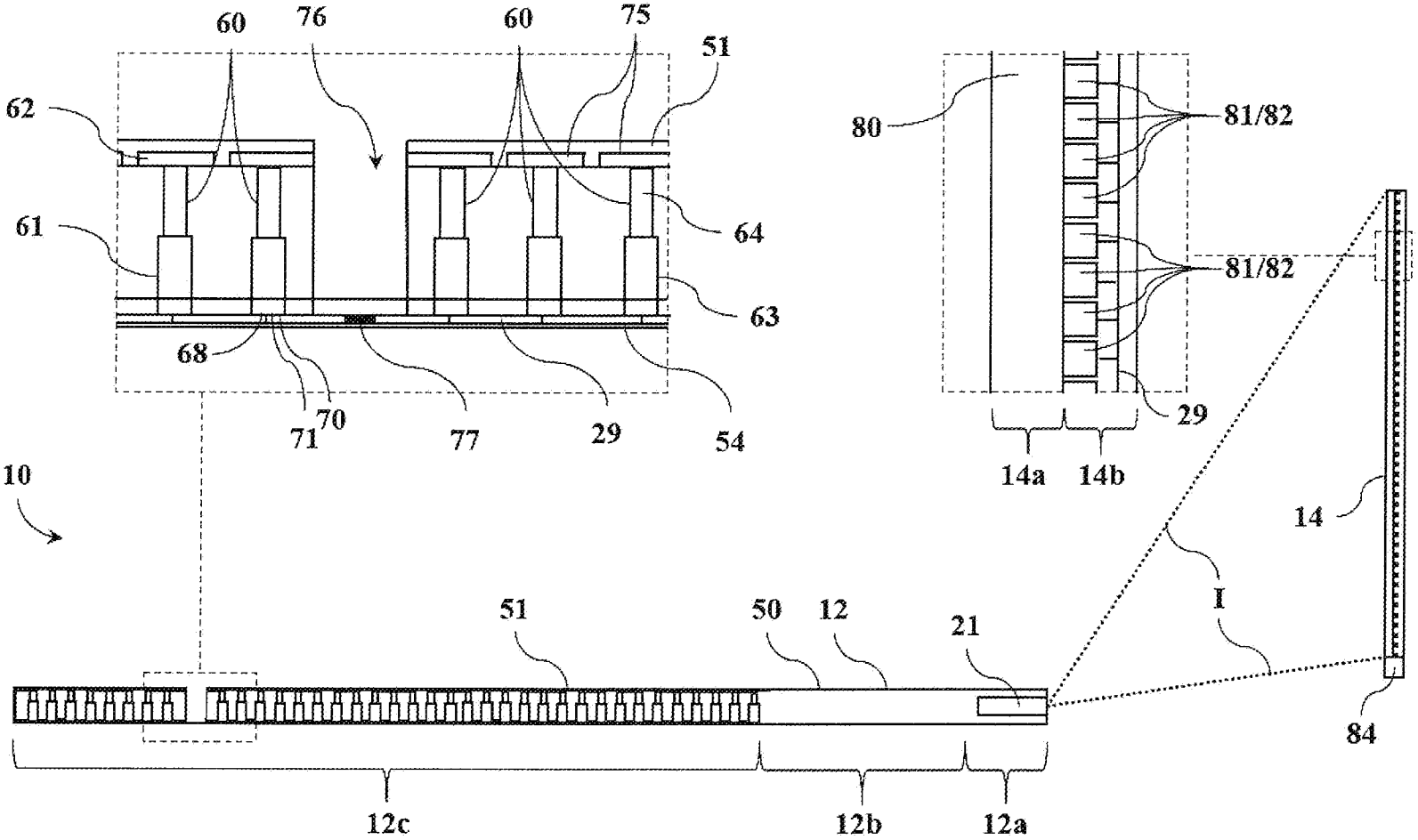
FIG. 4 illustrates a cross-sectional side view of the system of FIGS. 1 to 3, which is taken through line IV-IV in FIG. 2.
Figure 5:
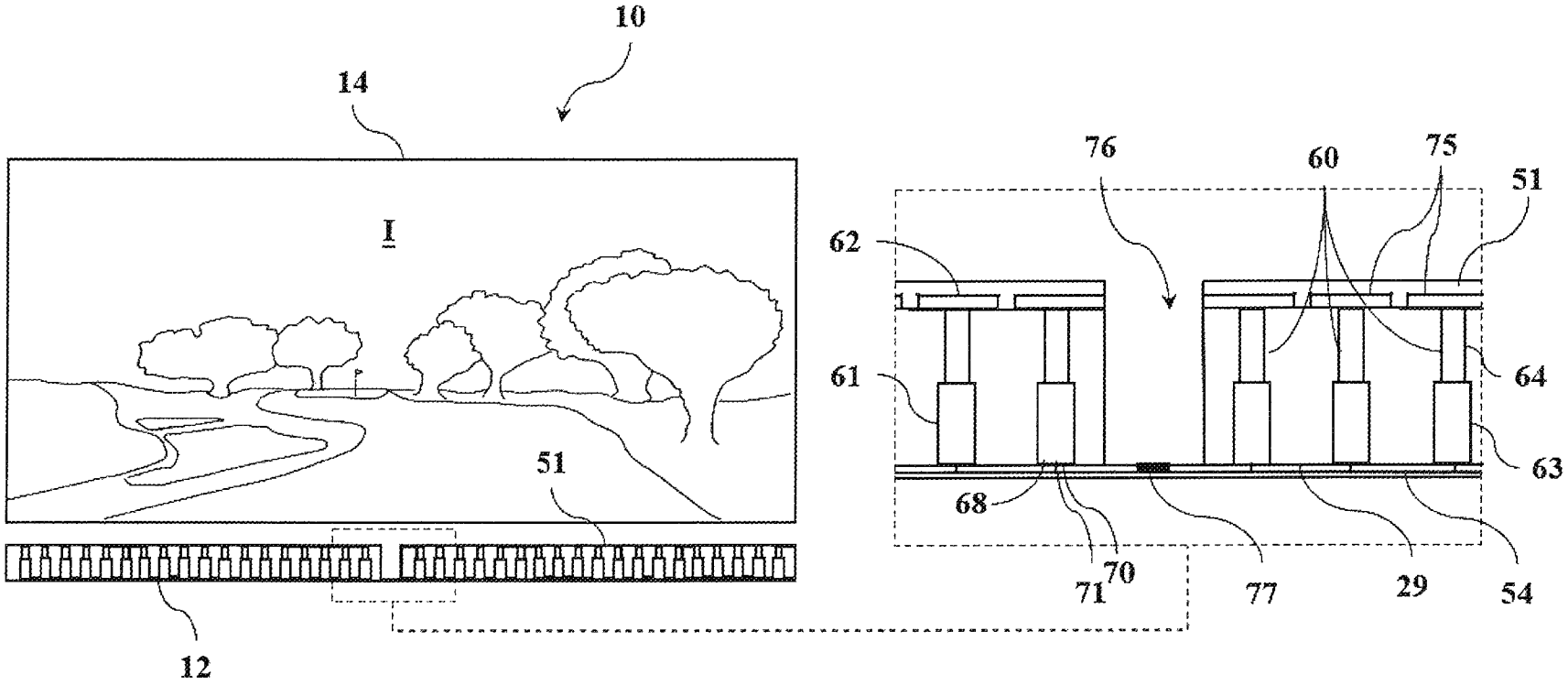
FIG. 5 illustrates a cross-sectional side view of the system of FIGS. 1 to 4, which is taken through line V-V in FIG. 2.

In an embodiment, the putting green surface 51 is configured to replicate the surface of a putting green on a real golf course. In an embodiment, the top of the putting green surface 51 can formed with an artificial grass having a length of about 0.10 to 0.15 inches. The putting green surface 51 can include a thin, flexible material which is capable of deforming based on the positioning of the putting green surface adjusters 60 located underneath. For example, the putting green surface 51 can be formed of rubber or flexible plastic. In an embodiment, the putting green surface 51 can be at least partially transparent so that the lights 66 below are visible to a golfer standing above. As illustrated in FIGS. 4 and 5, in an embodiment, the bottom of the putting green surface 51 can include a plurality of apertures 75, each of which is sized, shaped and positioned to receive a respective surface supporting portion 62 of a putting green surface adjuster 60.

In an embodiment, the putting portion 12*c* of the floor unit 12 further includes a putting hole 76 within the putting green surface 51. The putting hole 76 can extend through the putting green surface 51 and between putting green surface adjusters 60 as shown in FIGS. 4 and 5. The putting hole 76 can further include a transceiver 77 which is configured to detect the presence of a second ball 18 when the second ball 18 is chipped or putted into the putting hole 76. In an embodiment, the putting hole 76 is a movable part which can be moved to different locations of the putting green surface 51 for different final hole H placements for different golf holes GH. In an embodiment, the putting hole 76 is configured to be placed in an aperture 70 (e.g., with the transceiver placed in electrical communication with an electrical contact 71) such that the putting hole 76 can be swapped with a putting green surface adjuster 60, or vice versa, at any location including an aperture 70.

In an embodiment, the wall unit 14 includes a display portion 14*a* and a sensor portion 14*b*. The display portion 14*a* can include a display screen 80 configured to display the image I projected by the image projector 21. The display screen 80 can include, for example, a white fabric material configured to display the image I projected by the image projector 21.

In an embodiment, the sensor portion 14*b* includes one or more wall sensor 81. The one or more wall sensor 81 can include one or more wall proximity sensor 81*p* configured to detect the location (vertical and/or horizontal in FIG. 3) where a first ball 16 strikes the display portion 14*a*. The one or more sensor 81 can include one or more impact sensor 81*i* configured to measure the magnitude of impact of a first ball 16 striking the display portion 14*a*. The one or more sensor 81 can further include or be connected to a transceiver 82 configured to wirelessly send and/or receive signals from a first ball 16 and/or the control unit 24. In an embodiment, a plurality of sensors 81 can form a grid along the length and width of the sensor portion from the perspective of FIG. 3.

In an embodiment, the sensor portion 12*b* further includes a data transmission device 84 which wirelessly communicates with the control unit 24. More specifically, the data transmission device 84 can wirelessly transmit data from one or more sensor 81 to the control unit 24 for further processing by the control unit 24. Each of the sensors 81 and/or transceivers 82 can electrically connect to the data transmission device 84, for example, via wiring 29.

Figure 15:
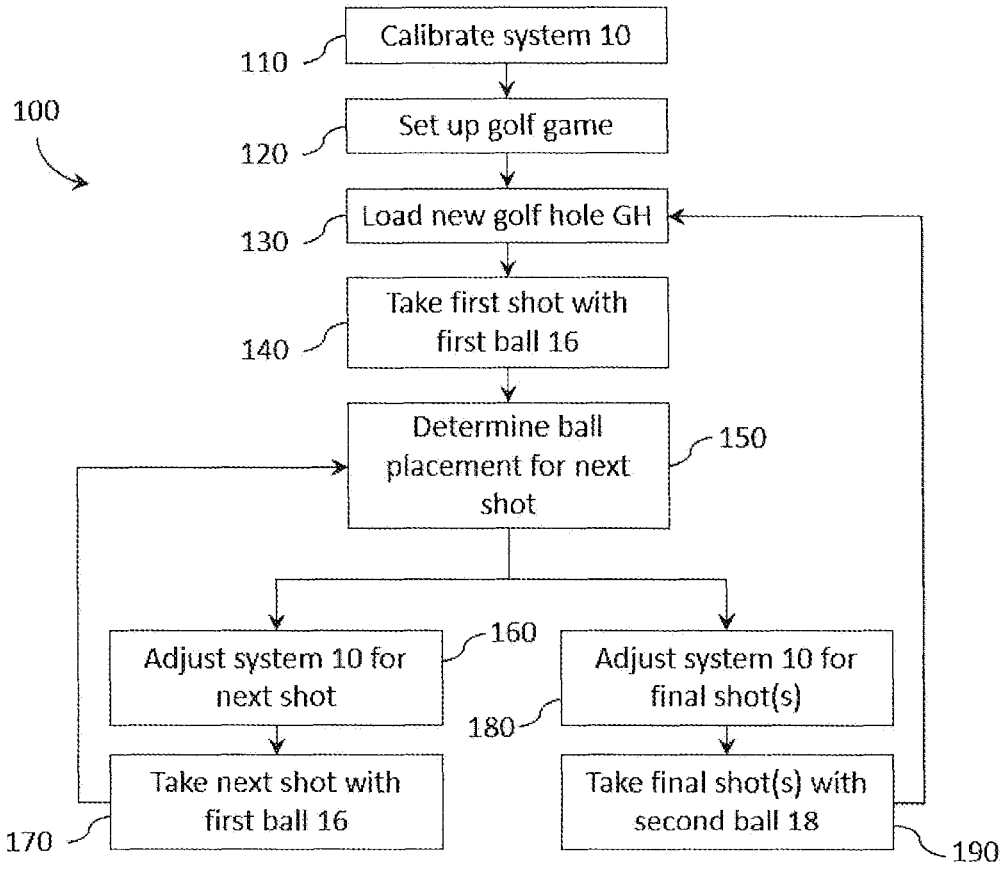
FIG. 15 illustrates an example embodiment of a method for playing a golf game in accordance with the present disclosure, which can be used with the system of FIGS. 1 to 5.
Figure 16:
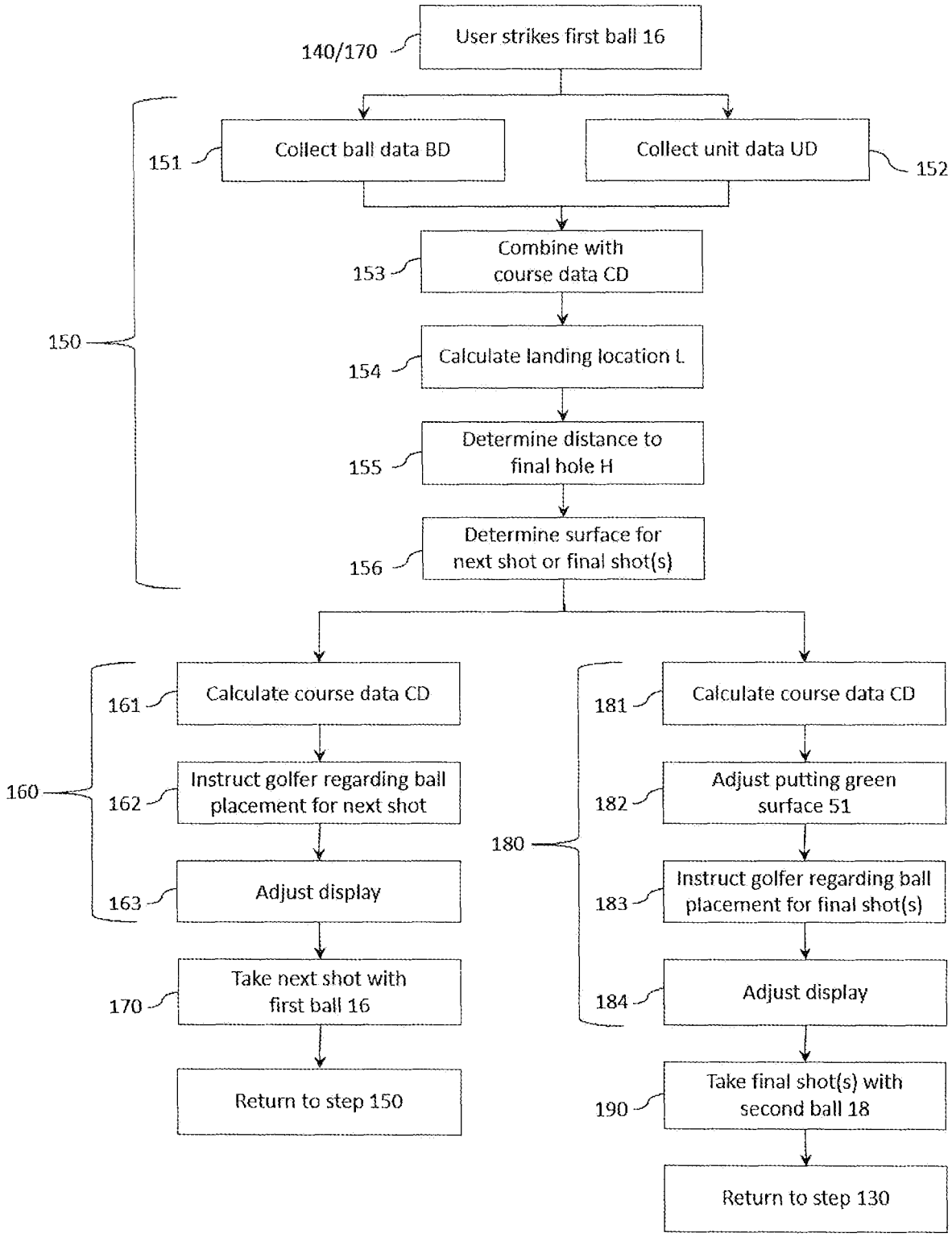
FIG. 16 illustrates a more detailed example embodiment of several of the steps of the method of FIG. 15.

FIGS. 15 and 16 illustrate an example embodiment of a method 100 for simulating a golf game in accordance with the present disclosure. It should be understood that the control unit 24 can be programmed to perform many of the steps of method 100 by causing the processor 25 to execute instructions stored on the memory 26. It should further be understood the many of the steps can be omitted or reordered without departing from the spirit and scope of method 100.

Figure 17:
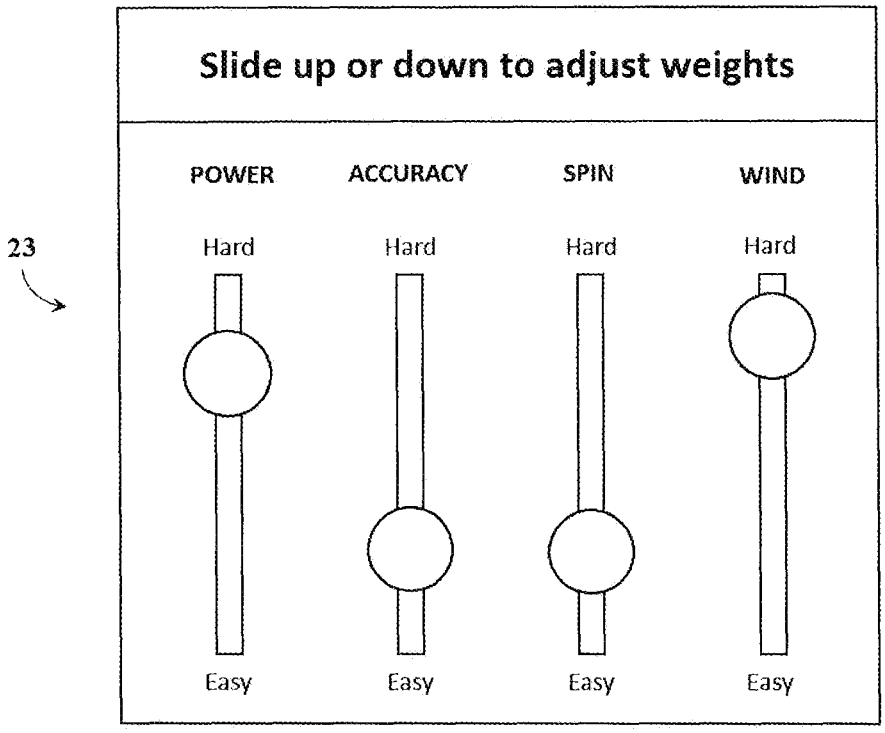
FIG. 17 illustrates an example embodiment of the display of a user interface of the system of FIGS. 1 to 5 during the method of FIG. 15 or 16.

At step 110, a golfer can calibrate the system 10 for a new game. In calibrating the system 10, the control unit 24 sets weights to be used when the golfer strikes the first ball 16 into the wall unit 14. The weights are then used to calculate the flight/distance of the golfer's shot taken with the first ball 16. The weights can be ball weights or course weights. The ball weights are applied to recorded data specific to the first ball 16 when struck by the golfer, while the course weights are applied to condition data generated for a simulated golf hole GH being played by the golfer. For example, FIG. 17 illustrates an example embodiment of the display of a user interface 23 during calibration, which is configured to allow a golfer to select his or her weights by sliding respective indicators up or down. In the example of FIG. 17, the power weight, the curve weight and the spin weight are ball weights, while the wind weight is a course weight. Those of ordinary skill in the art will further recognize from this disclosure that these are examples only and that different or additional weights can also be used.

In a simple embodiment, the golfer can choose to use standard weights which have been predetermined by the system 10. The standard weights can be intended to simulate the true flight path and distance of a golfer's shot taken with a first ball 16. Thus, the standard weights can be used to simulate the most realistic golf game using the system 10.

In an embodiment, the golfer can set a weight for the power of his or her shots. The power weight increases or decreases the simulated length of each shot that is taken using a first ball 16. The golfer may want to increase shot power, for example, if he or she does not have a strong swing and wishes to increase the distance that simulated shots travel. The golfer may want to decrease his or her shot power, for example, if playing against another golfer with a weaker shot, thus leveling the playing field.

In an embodiment, the golfer can set a weight to regulate the hook and/or slice of a shot (hereinafter the "curve weight"). The curve weight increases or decreases the distance that a shot taken using a first ball 16 might fade to the left or right after being hit by the golfer (e.g., regulate the hook and/or slice of each shot). The golfer may want to increase his or her hook/slice, for example, to make a golf game more challenging. The golfer may want to decrease their hook/slice, for example, if their shots tend to hook or slice more than they prefer.

In an embodiment, the golfer can set a weight for the spin of their shots. The spin weight increases or decreases the amount of ball spin of each shot that is taken using a first ball 16. The golfer may want to increase the spin, for example, if they have a difficult time spinning a golf ball as much as they prefer. The golfer may want to decrease their spin, for example, if they tend to spin a golf ball more than they intend.

In an embodiment, the golfer can set a weight for wind. The wind weight increases or decreases the effect of simulated wind on each shot taken with a first ball 16. The golfer may want to increase the wind, for example, to make a golf game played with system 10 more challenging. The golfer may want to decrease the wind, for example, to make a golf game played with system 10 less challenging.

In another embodiment, the golfer can choose between different game settings, for example, "Easy," "Medium," or "Hard," and the system 10 can set some or all of the weights based on the golfer's selection. Further, if multiple golfers are playing a competition using the system 10, then each golfer can have different weights applied to their shots. For example, a first golfer can choose an "Easy" difficulty and have one set of weights applied to their shots, while a second golfer can choose a "Hard" difficulty and have another set of weights applied to their shots. In this way, the system 10 can handicap the golfers so that golfers of different skill sets can play a competitive game using the system 10.

In an embodiment, the system 10 is configured to perform an autocalibration for a plurality of golfers to handicap the golfers, thus evening the playing field. In this embodiment, each golfer can take one or more shots into the wall unit 14 using a first ball 16. The shots can be taken from one or more of the hitting surfaces 50 into the wall unit. The system 10 can thereafter compare various factors of the golfer's shots such as power, spin and accuracy, and can apply weights for each of the golfers based on the comparison. For example, if a first golfer tends to hit the first ball about 10% harder than a second golfer (e.g., on average), then the system 10 can set the second golfer's power weight to be 10% higher than the first golfer. The same calculations can be made for other weights being applied by the system (e.g., using spin and/or accuracy).

In an embodiment, the system 10 is configured to be calibrated to provide club recommendations to a golfer playing a golf game. The calibration can be performed before the golf game or can be a continuous calibration performed while the golfer is playing the golf game. To calibrate for club recommendations, the control unit 24 can record data from shots taken by the golfer using different golf clubs. For example, for each club the golfer physically uses, the control unit 24 can calculate the average distance that the club causes a virtual ball to travel across the virtual golf hole GH. Then, before a golfer takes a shot during the golf game, the system 10 can provide a club recommendation by comparing those average distances to the distance between the current location L and the final hole H.

At step 120, one or more golfer can set up a golf game using system 10. More specifically, the golfer can set up a golf game using the control unit 24. In setting up the golf game, the golfer can select, for example, the golf course which will be simulated and the number of holes. The system 10 enables real golf courses to be simulated, such that real golf holes are recreated as virtual golf holes GH. Alternatively, the golfer can generate a random golf course to play.

In an embodiment, the golfer can further set up various factors such as weather or course conditions, e.g., high or low winds, fast or slow fairway, wet or dry surfaces, etc., which can affect how the path of each shot taken using a first ball 16 is calculated. Alternatively, the golfer can randomize the weather or course conditions. The weather and course conditions determined at this step can be used by the control unit 24 to adjust the course weights.

At step 130, the system loads a new golf hole GH to be played by one or more golfers. If the golfer is just beginning a golf game, then the new golf hole GH is the first golf hole GH. Otherwise, the new golf hole GH is a next golf hole GH (e.g., a second golf hole GH, a third golf hole GH, etc.).

In an embodiment, when the new golf hole GH is loaded, the control unit 24 causes the image projector 21 to display an image I of the new golf hole GH on the wall unit 14, for example, as shown in FIGS. 1 and 2. The image I is taken from the perspective of where the golfer is hitting from. For example, if the golfer is taking a tee shot, then the image is of the golf hole GH from the perspective of the tee box B. The image I can further include various other information, for example, the number of golfers, their current scores, the wind speed and wind direction of the simulated hole, and/or the distance of the golfer's current position to the final hole H. That is, when the control unit 24 loads the new golf hole GH, the control unit 24 also loads course data CD related to the conditions for the golf hole GH (e.g., wind speed, surface speed, etc.)

In an embodiment, the image I of the new golf hole GH is displayed on a headset 200, as discussed in more detail below. The headset 200 is configured to provide the golfer with a 360-degree view of the virtual golf hole GH from the perspective of where the golfer's ball is located. Thus, for example, at step 130, the headset 200 is configured to provide the golfer with a 360-degree view of the virtual golf hole GH from the perspective of the tee box B where the golfer will hit the first shot from.

At step 140, the golfer takes his or her first shot. The first shot is typically the tee shot. To take the first shot, the golfer first places a first ball 16 in a striking zone 56. In an embodiment, the first ball 16 can be placed on a tee for the tee shot, which can be built into the striking zone 56. When the first ball 16 is placed in a striking zone 56, the transceiver 32 for that striking zone 56 can detect the presence of the first proximity sensor 40*p* of the first ball 16 and determine that the first ball 16 has been placed in that striking zone 56. The transceiver 32 can further send a signal to the transceiver 42 of the first ball 16 to trigger the light 41, indicating to the golfer that the first ball 16 has been placed in the correct striking zone 56.

In an embodiment, the golfer chooses the striking zone 56 from which the golfer wishes to take the first shot with the first ball 16. When the first ball 16 is placed in the golfer's chosen striking zone 56, the transceiver 32 for that striking zone 56 can detect the presence of the first proximity sensor 40*p* of the first ball 16 and notify the control unit 24. The positioning of the first ball 16 can then be used by the control unit 24 when calculating the flight path and/or distance of the first ball 16.

Figure 18A:
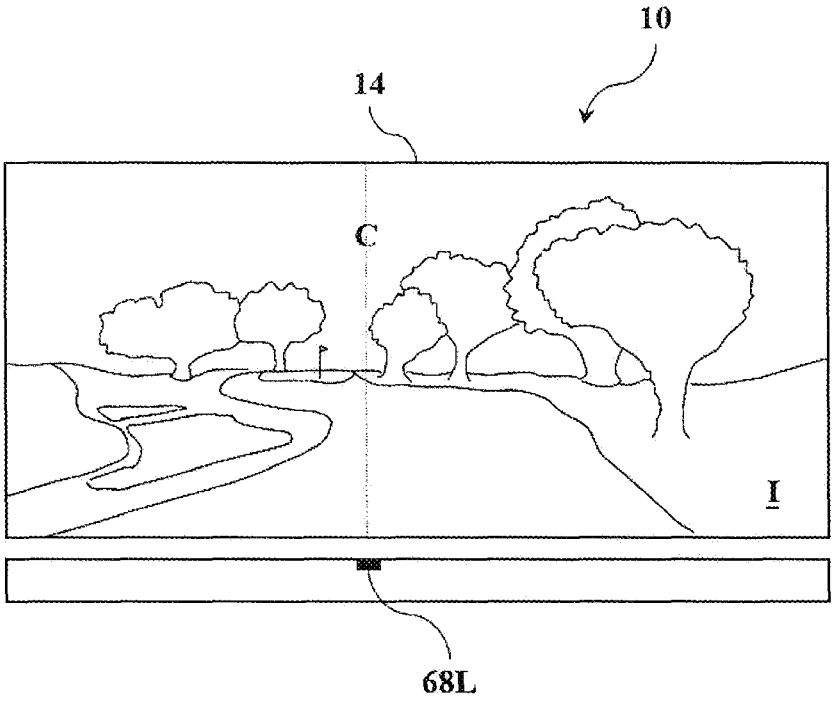
FIGS. 18A and 18B illustrate example embodiments of how the image on a wall unit of the system of FIGS. 1 to 5 can be shifted based on where a golfer places a golf ball.
Figure 18B:
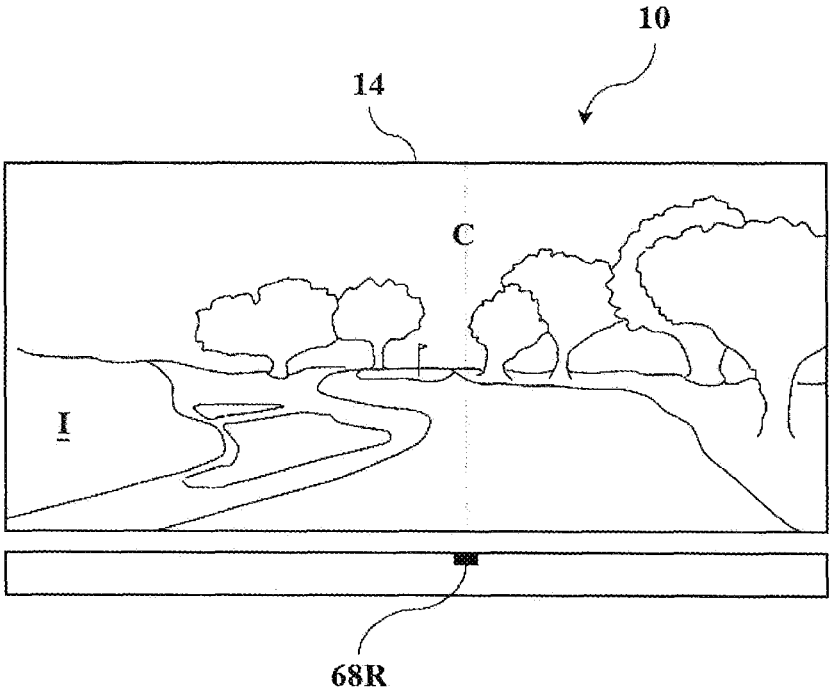

In an embodiment, the control unit 24 shifts the image I based on the striking zone 56 in which the golfer places the first ball. For example, as shown in FIGS. 18A and 18B, the center C of the image I can be shifted to be directly in front of the striking zone 56 which the golfer will hit from. In FIG. 18A, the golfer is hitting from a left striking zone 56L within the first hitting surface 50*a*, and the center C of the image I is shifted leftward accordingly. Likewise, in FIG. 18B, the golfer is hitting from a right striking zone 56R of the first hitting surface 50*a*, and the center C of the image I is shifted rightward accordingly.

The golfer can then choose a golf club for the tee shot. With the presently disclosed system, the golfer is able to play with his or her own set of golf clubs. In an alternative embodiment, the system 10 can be configured for use with specialized golf clubs having their own sensors which affect the calculation of ball flight and/or distance.

The golfer can then hit the first ball 16 into the wall unit 14. More specifically, the golfer can hit the first ball 16 from the striking zone 56 of the first hitting surface 50*a* into the display screen 80 of the wall unit 14. Upon the first ball striking the wall unit, the control unit 24 can collect ball data BD and unit data UD, as described in more detail below.

At step 150, the control unit 24 is configured to determine the ball placement for the next shot. More specifically, the control unit 24 can determine the landing spot of the golfer's shot in relation to the virtual golf hole GH. The control unit 24 can determine the landing spot, for example, by calculating the flight path of the shot using the ball data BD, unit data US, and/or course data CD. The control unit 24 can further cause the image projector 21 to display the flight path within the image I so that the golfer can watch the ball fly across the virtual golf hole GH.

As illustrated in more detail by FIG. 16, in an embodiment, the control unit 24 begins by collecting ball data BD at step 151 and/or unit data UD at step 152. The ball data BD is data recorded by one or more sensor 50 of the first ball 16, for example, ball speed data and/or ball spin data. The unit data UD is data recorded by the floor unit 12 and/or wall unit 14, for example, positioning data related to the striking zone 56 from which the golfer hit, location data recorded by a sensor 81 of the wall unit regarding the X and Y coordinates of where the first ball 16 struck the wall unit 14, and/or impact data regarding the power of the impact when the first ball 16 struck the wall unit 14.

At step 153, the control unit 24 combines the ball data BD and/or the unit data UD with the course data CD loaded at step 130. In various embodiments, one or more of these types of data can be omitted.

At step 154, the control unit 24 determines the landing location L of the current shot. The control unit 24 can determine the landing location L by calculating the flight path of the ball on the virtual golf hole GH. The control unit 24 can calculate the flight path, for example, by determining the flight distance, flight angles, and/or curve of the shot taken with the first ball 16.

In an embodiment, the flight distance is based on the power of the shot taken with the first ball 16. The power of the shot can be indicated by ball data BD generated by a speed sensor 40*d* of the first ball 16 and/or by unit data UD generated by an impact sensor 81*i* of the wall unit 14. The flight distance can further be affected by course data CD regarding wind speed, wind direction, surface speed, etc. Here, corresponding power weights can further be applied to lengthen or shorten the flight distance.

In an embodiment, the flight angle is based on the vertical and horizontal angles of the shot taken with the first ball 16 with respect to the striking zone 56. These angles can be determined, for example, based on unit data UD regarding the location where the first ball 16 strikes the wall unit 14 as detected by a proximity sensor 80*p* and/or an impact sensor 80*i* of the wall unit 14. Knowing the striking zone 56 from which the first ball was hit, along with the distance between the striking zone 56 and the wall unit 14, the control unit 24 can calculate the vertical and horizontal angles using simple geometric equations. Here, corresponding accuracy weights can further be applied to increase or decrease the flight angle.

In an embodiment, the curve of the shot indicates the hook or slice of the shot based on how the golfer hit the first ball 16. The curve of the shot can be indicated by ball data BD generated by a spin sensor 40*d* of the first ball 16. The curve of the shot can further be affected by course data CD regarding wind speed and wind direction. Here, corresponding spin weights can further be applied to increase or decrease the curve of the flight path.

In an embodiment, the control unit 24 is configured to calculate the simulated flight path of the ball on the virtual golf hole GH using the flight distance, flight angles, and/or the curve of the shot taken with the first ball 16. The control unit can further use course data such as the surface speed and weather conditions (e.g., wet or dry) to further influence the flight path and/or determine how the ball rolls after hitting the ground on the virtual golf hole GH. Based on this calculation, the control unit 24 can determine the landing location L which marks the final resting place of the ball on the virtual golf hole GH.

At step 155, the control unit determines the distance d between the landing location L and the final hole H. If the distance d is greater than the predetermined radius PR used to mark the area AR for that golf hole GH, and thus the landing location L is not within the area AR, then the method 100 proceeds step 160 and the golfer again uses a first ball 16 for the next shot. The golfer's next shot will again be from a hitting surface 50 in the direction D1. If the distance d is less than the predetermined radius PR used to mark the area AR for that golf hole GH, and thus the landing location L is within the area AR, then the method 100 proceeds to step 180 and the golfer switches to a second ball 18. The system 10, for example using the image projector 21 and/or the headset 200, can inform the golfer which ball to use for the next shot and/or where the next shot will take place from.

At step 160, the golfer is again hitting a first ball 16 into the wall unit 14. Based on where the golfer's previous landing location L, the control unit 24 can instruct the golfer where to place the first ball 16 for the next shot. More specifically, the control unit 24 can instruct the golfer which hitting surface 50 to place the ball on and/or where on the hitting surface 50 to place the first ball 16.

As illustrated in more detail by FIG. 16, in an embodiment, the control unit 24 begins prompting the next shot by determining the course data CD related to the current position at step 161. For example, the simulated wind direction may have changed based on the landing location L.

At step 162, the control unit 24 is configured to instruct the golfer where to place the first ball 16 to take the next shot. For example, if the golfer's previous simulated shot landed in the fairway F of the golf hole GH, then the control unit 24 can instruct the golfer to place the first ball 16 on the fairway hitting surface 50*a*. Likewise, if the golfer's previous simulated shot landed in the rough R of the golf hole GH, then the control unit 24 can instruct the golfer to place the first ball 16 on the rough hitting surface 50*b*. Likewise, if the golfer's previous simulated shot landed in a sand trap S of the golf hole GH, then the control unit 24 can instruct the golfer to place the first ball 16 on the sand hitting surface 50*c*.

In an embodiment, the control unit 24 is configured to instruct the golfer as the precise striking zone 56 to place the first ball 16. When the first ball 16 is placed in the striking zone 56, the transceiver 32 for that striking zone 56 can detect the presence of the first proximity sensor 40*p* of the first ball 16 and determine that the first ball 16 has been placed in the correct or incorrect striking zone 56. If the first ball 16 has been placed in the correct striking zone 56, the transceiver 32 can further send a signal to the transceiver 42 of the first ball 16 to trigger the light 41, indicating to the golfer that the first ball 16 has been placed in the correct striking zone 56.

In another embodiment, the golfer can choose the striking zone 56 from which the golfer wishes to take the next shot with the first ball 16, as long as the golfer is hitting from the correct hitting surface 50. When the first ball 16 is placed in the golfer's chosen striking zone 56, the transceiver 32 for that striking zone 56 can detect the presence of the first proximity sensor 40*p* of the first ball 16 and notify the control unit 24. The positioning of the first ball 16 can then be used by the control unit 24 when calculating the flight path of the first ball 16.

At step 163, the control unit 24 causes the image projector 21 to display a new image I. The new image I can be a three-dimensional image of the remaining portion of the golf hole GH from the perspective of the golfer at the landing location L, e.g., from where the golfer's ball is located on the golf hole GH. The control unit 24 can further adjust the center C of the image to reflect the position that the first ball 16 is being hit from.

In an embodiment, the image I of the golf hole GH is displayed on a headset 200, as discussed in more detail below. More specifically, the headset 200 is configured to provide the golfer with a 360-degree view of the virtual golf hole GH from the perspective of the landing location L, e.g., from where the golfer's ball is located on the golf hole GH. Thus, the golfer can examine the golf course from where he or she will hit the next shot.

At step 170, the golfer again hits the first ball 16 into the wall unit 14. The method 100 then returns to step 150 so that the control unit 24 can calculate the ball's next flight path as discussed above. Steps 150, 160 and 170 can be repeated until the control unit 24 simulates the golfer's shot landing within a distance d of the final hole H that is less than the predetermined radius PR used to mark the area AR for that golf hole GH, and thus the landing location L is within the area AR.

Figure 19:
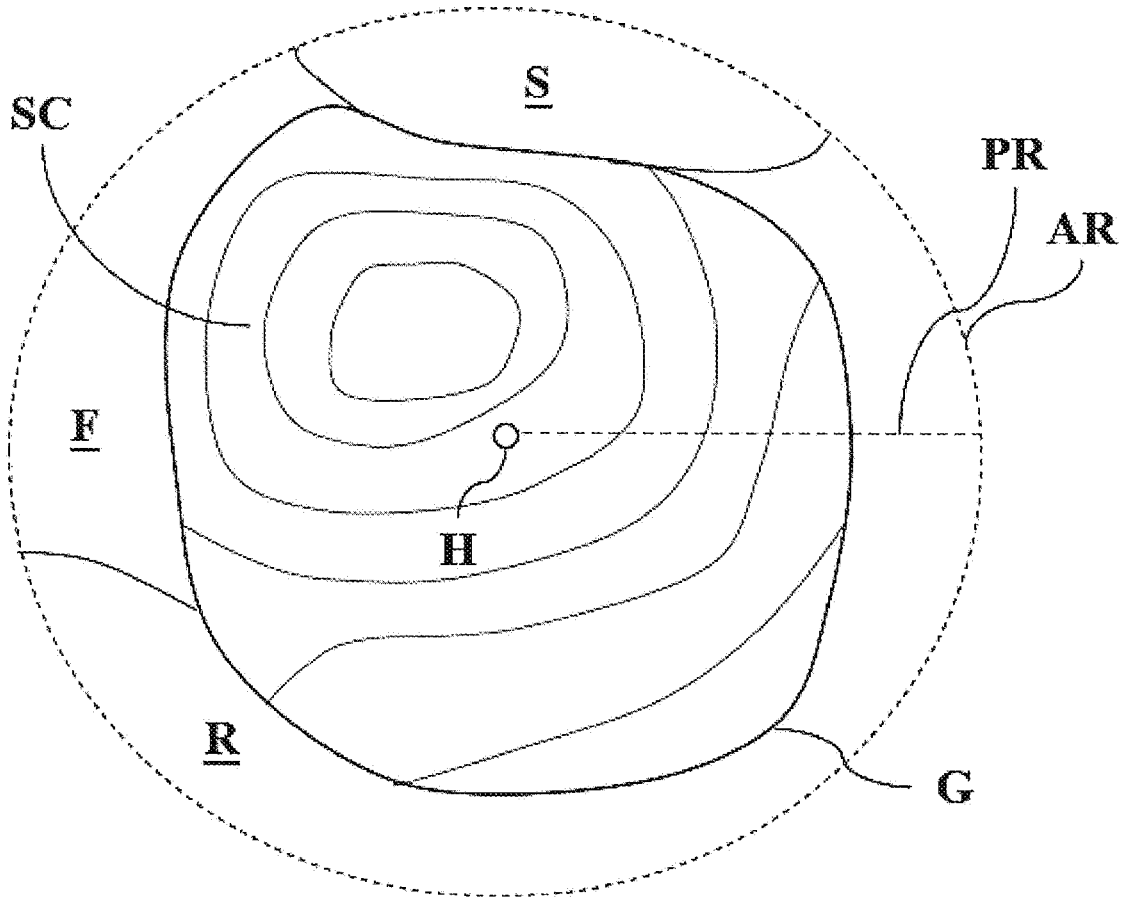
FIG. 19 illustrates an example embodiment of a virtual putting green G and its surface contour.

At step 180, the golfer's previous shot has landed within the distance d of the final hole H that is less than the predetermined radius PR. The system 10 determines the type of surface 50 of the landing location L. Based on this information, the system 10 adjusts the putting green surface 62 and instructs the golfer where on the floor unit 12 to place a second ball 18 for the final shot(s) of the current golf hole GH. FIG. 19 illustrates an example embodiment showing how a landing location can be located on a fairway F, rough R, sand trap S and/or putting green G and be within the predetermined radius PR used to mark the area AR for that golf hole GH.

In an embodiment, if the golfer's previous simulated shot landed on the putting green G, then the system 10 instructs the golfer to place a second ball 18 on the putting green surface 51 to begin the final one or more shot of the current golf hole GH. If the golfer's previous simulated shot landed on the fairway, rough, a sand trap or another surface, then the system 10 instructs the golfer to place a second ball 18 on a corresponding hitting surface 50. For example, if the golfer's previous simulated shot landed on the fairway F, then the system 10 instructs the golfer to place a second ball 18 on the fairway hitting surface 50*a*; if the golfer's previous simulated shot landed in the rough R, then the system 10 instructs the golfer to place a second ball 18 on the rough hitting surface 50*b*; if the golfer's previous simulated shot landed in a sand trap S, then the system 10 instructs the golfer to place a second ball 18 on the sand hitting surface 50*c*.

Figure 20A:
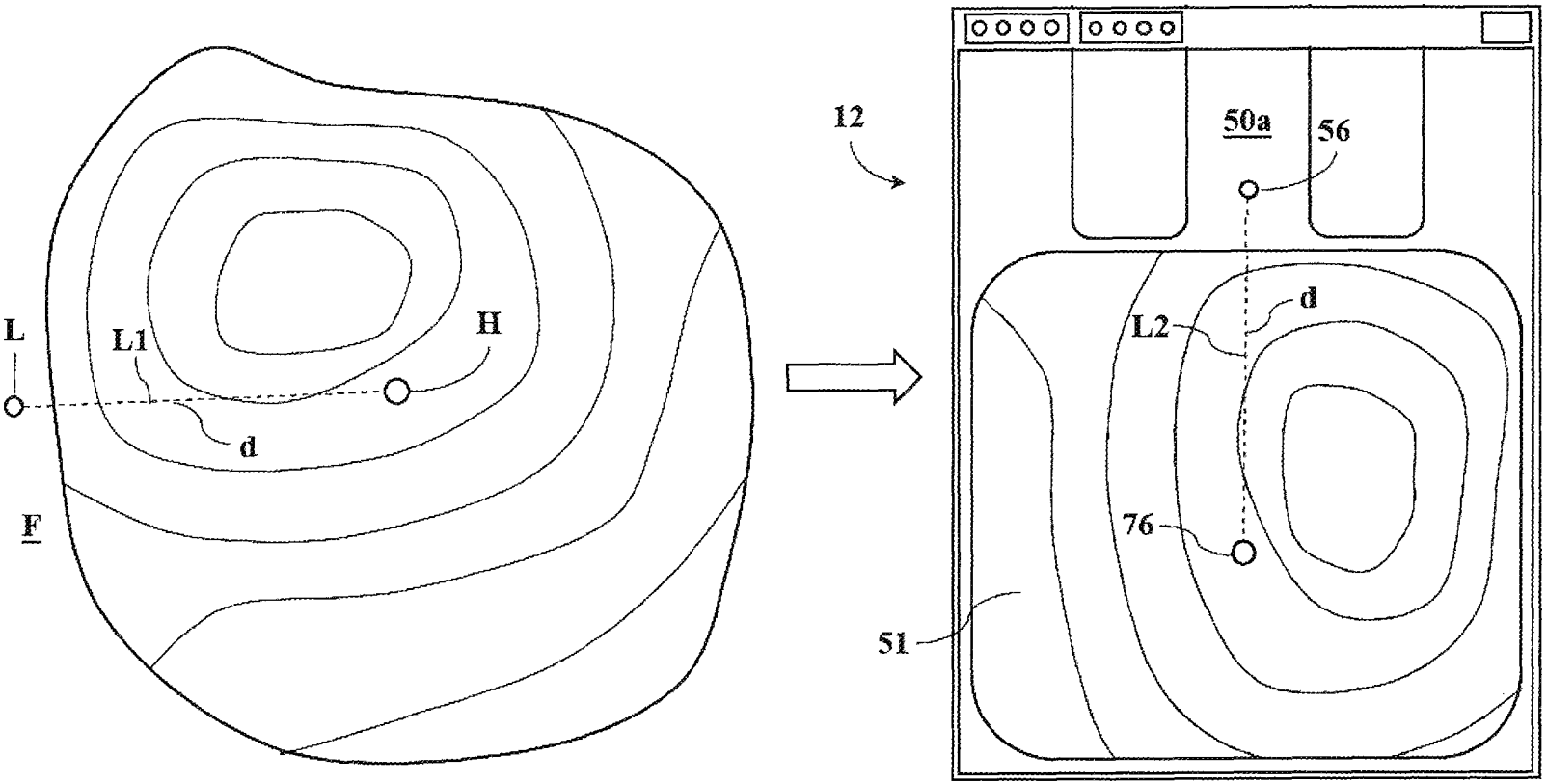
FIGS. 20A to 20D illustrate an example embodiment of how the system of FIGS. 1 to 5 can adjust its putting green surface to reflect a specific surface contour in accordance with the method of FIG. 15 or 16.

FIG. 20A illustrates a first example embodiment in which the golfer's landing location L is on a fairway F within the predetermined radius PR. The control unit 24 therefore selects a corresponding striking zone 56 within the fairway hitting surface 50*a* which places the second ball 18 at the distance d from the putting hole 76. The control unit 24 also rotates the surface contour SC so that the virtual line L1 between the landing location L and the final hole H can be matched by the line L2 between the physical line between the striking zone 56 and the putting hole 76. The control unit 24 can then independently control each of the putting green surface adjusters 60 so that the contour of the putting green surface 51 accurately mimics the surface contour SC from the golfer's landing location L within the fairway F.

Figure 20B:
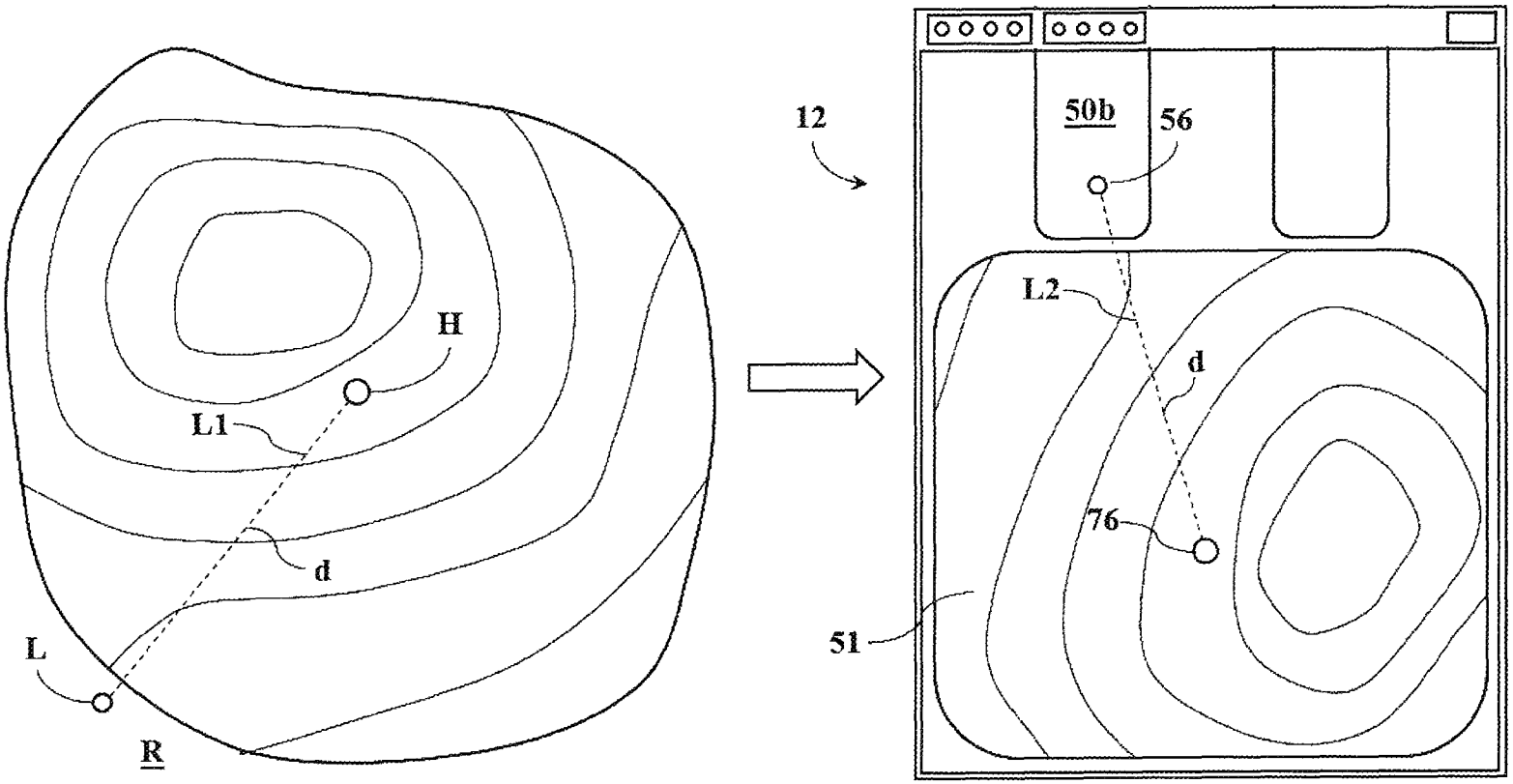

FIG. 20B illustrates a second example embodiment in which the golfer's landing location L is on a rough R within the predetermined radius PR. The control unit 24 therefore selects a corresponding striking zone 56 within the rough hitting surface 50*b* which places the second ball 18 at the distance d from the putting hole 76. The control unit 24 also rotates the surface contour SC so that the virtual line L1 between the landing location L and the final hole H can be matched by the line L2 between the physical line between the striking zone 56 and the putting hole 76. The control unit 24 can then independently control each of the putting green surface adjusters 60 so that the contour of the putting green surface 51 accurately mimics the surface contour SC from the golfer's landing location L within the rough R.

Figure 20C:
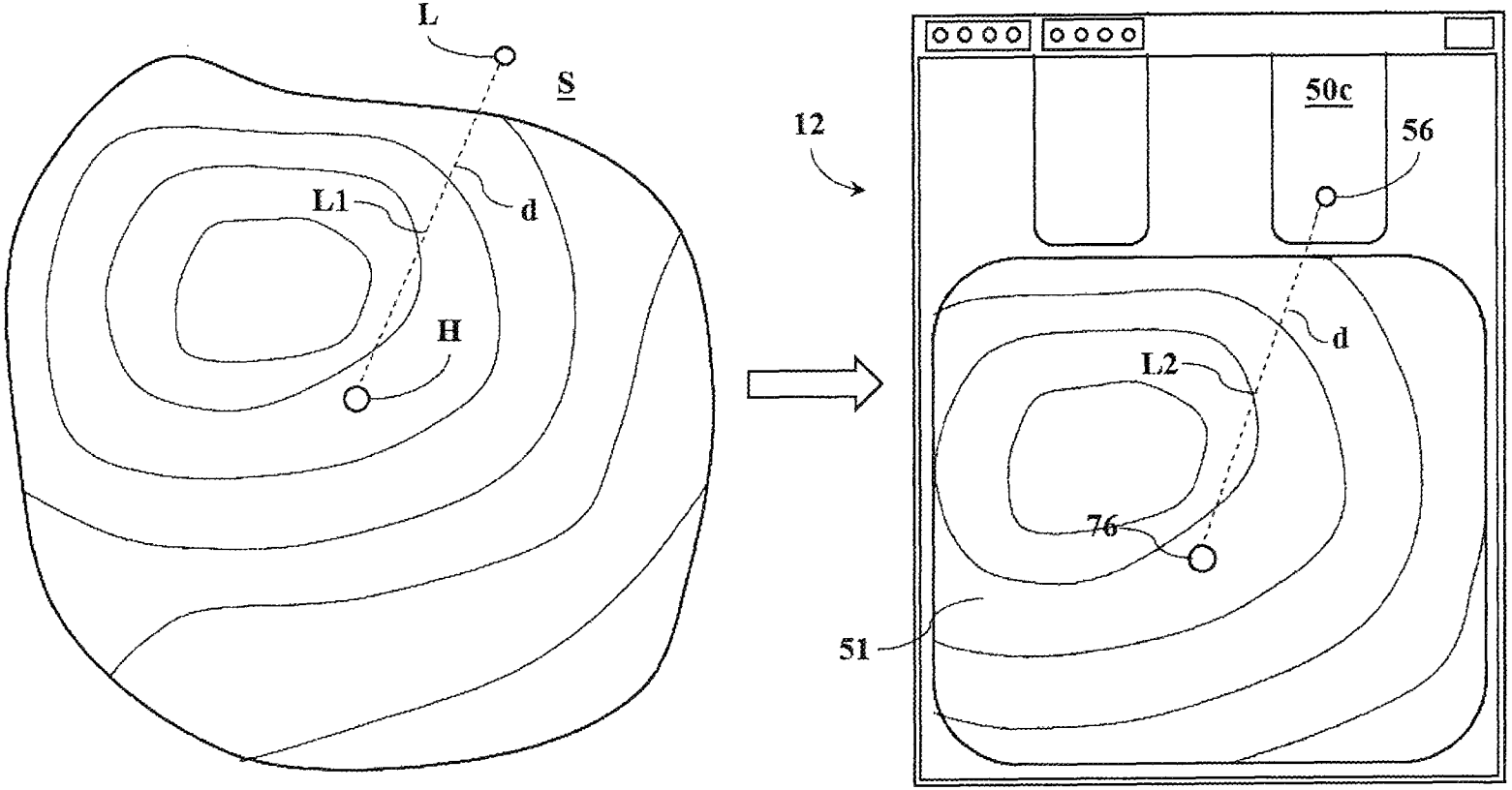

FIG. 20C illustrates a third example embodiment in which the golfer's landing location L is on a sand trap S within the predetermined radius PR. The control unit 24 therefore selects a corresponding striking zone 56 within the sand hitting surface 50*c* which places the second ball 18 at the distance d from the putting hole 76. The control unit 24 also rotates the surface contour SC so that the virtual line L1 between the landing location L and the final hole H can be matched by the line L2 between the physical line between the striking zone 56 and the putting hole 76. The control unit 24 can then independently control each of the putting green surface adjusters 60 so that the contour of the putting green surface 51 accurately mimics the surface contour SC from the golfer's landing location L within the sand trap S.

Figure 20D:
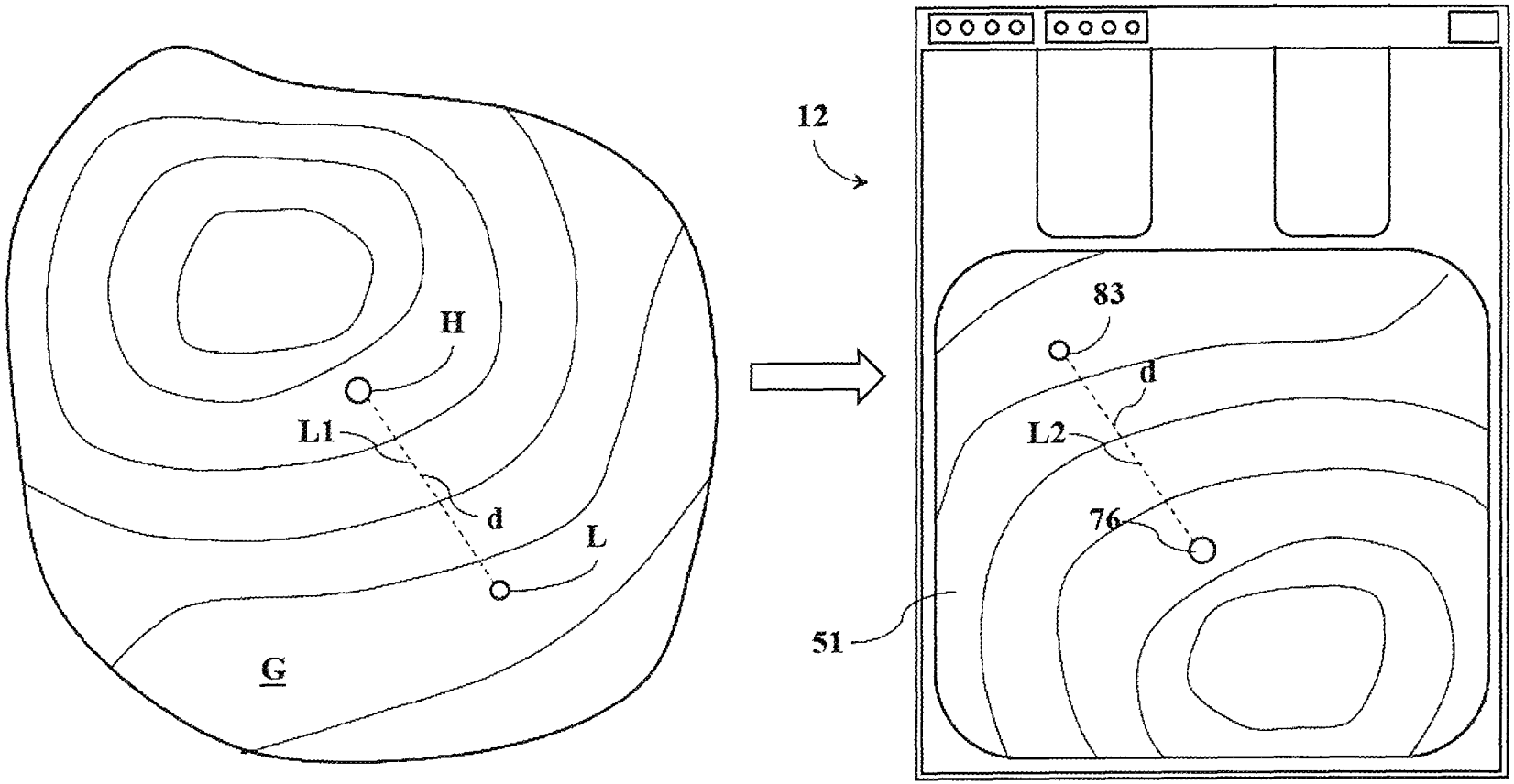

FIG. 20D illustrates a fourth example embodiment in which the golfer's landing location L is the putting green G. The control unit 24 therefore selects a location on the putting green surface 51 which places the second ball 18 at the distance d from the putting hole 76. The control unit 24 also rotates the surface contour SC so that the virtual line L1 between the landing location L and the final hole H can be matched by the line L2 between the physical line between the putting location 83 and the putting hole 76. The control unit 24 can then independently control each of the putting green surface adjusters 60 so that the contour of the putting green surface 51 accurately mimics the surface contour SC from the golfer's landing location L on the putting green G.

As illustrated in more detail by FIG. 16, in an embodiment, the control unit 24 begins prompting the final shot(s) with the second ball 18 by determining the course data CD related to the current position at step 181. The course data D can include the landing location L and the surface contour SC with respect to the landing location L.

At step 182, the control unit 24 adjusts the putting green surface 51. More specifically, the control unit 24 can rotate the surface contour SC as described above, so that the virtual line L1 between the landing location L and the final hole H can be matched by the line L2 between the physical line between the striking zone 56 and the putting hole 76. The control unit can independently control each of the putting green surface adjusters 60 so that the contour of the putting green surface 51 accurately mimics the surface contour SC from the golfer's landing location L. More specifically, the control unit 24 can cause each surface supporting portions 62 of a putting green surface adjuster 60 to be raised or lowered based on the surface sections SS1, SS2 . . . SSn which determine the surface contour SC.

At step 183, the control unit 24 instructs the golfer where to place the second ball 18 to take the final shot(s). For example, if the golfer's previous shot landed in the fairway F of the golf hole GH, then the control unit 24 can instruct the golfer to place the first ball 16 on the fairway hitting surface 50*a*; if the golfer's previous simulated shot landed in the rough R of the golf hole GH, then the control unit 24 can instruct the golfer to place the first ball 16 on the rough hitting surface 50*b*; if the golfer's previous simulated shot landed in a sand trap S of the golf hole GH, then the control unit 24 can instruct the golfer to place the first ball 16 on the sand hitting surface 50*c*; if the golfer's previous simulated shot landed on the putting green G of the golf hole GH, then the control unit 24 can instruct the golfer to place the first ball 16 on the putting surface 51.

In an embodiment, the control unit 24 instructs the golfer as the precise striking zone 56 to place the second ball 16 and/or at the precise location on the putting green surface 51. When the second ball 18 is placed in the correct striking zone 56, the transceiver 32 for that striking zone 56 can detect the presence of the second proximity sensor 46*p* of the second ball 18 and determine that the second ball 18 has been placed in the correct or incorrect striking zone 56. If the second ball 18 has been placed in the correct striking zone 56, the transceiver 32 can further send a signal to the transceiver 48 of the second ball 18 to trigger the light 47, indicating to the golfer that the second ball 18 has been placed in the correct striking zone 56. Likewise, when the second ball 18 is placed on the putting green, the transceiver 67 of the putting green surface adjuster 60 located beneath the second ball can detect the presence of the second proximity sensor 46*p* of the second ball 18 and determine whether the second ball 18 has been placed in the correct location on the putting green surface 51. If the second ball 18 has been placed in the correct location on the putting green surface, the transceiver 67 can further send a signal to the transceiver 48 of the second ball 18 to trigger the light 47, indicating to the golfer that the second ball 18 has been placed in the correct striking zone 56.

At step 184, the control unit 24 adjusts the image I on the display screen to reflect, for example a three-dimensional image of the golf hole GH from the perspective of the golfer. The control unit 24 can also adjust the image I to provide information regarding the distance to the hole, the surface contour SC, and/or other information which the golfer may appreciate.

In an embodiment, the image I of the golf hole GH is displayed on a headset 200, as discussed in more detail below. More specifically, the headset 200 is configured to provide the golfer with a 360-degree view of the virtual golf hole GH from the perspective of where the ball is located on the putting green G. Thus, the golfer can look around the golf hole GH from where he or she will putt next. In an embodiment, the golfer can walk around and use the headset 200 to examine the golf hole GH from various locations and/or perspectives, thus enabling the golfer to carefully examine the putting green G and/or its surface contour SC. In an embodiment, the headset 200 can instruct the golfer where to place the second ball 18 for the next shot, for example, by displaying an image of the ball and/or location.

At step 190, the golfer can hit the final shot(s) of the golf hole by hitting the second ball 18 into the putting hole 76. A skilled golfer may only require one final shot; an amateur may require more. The golfer should be able to take the final shots using a wedge or putter without the putting green surface 51 again needing adjustment. In various embodiments, however, the putting green surface can continue to be further adjusted after a chip or putt.

In an embodiment, when the golfer finally hits the second ball 18 into the putting hole 76, the transceiver 77 of the putting hole 76 detects the presence of a second ball 18 and determine the golfer's score for that golf hole GH. The system 10 can then return to step 130 and load a new golf hole GH.

Figure 21:
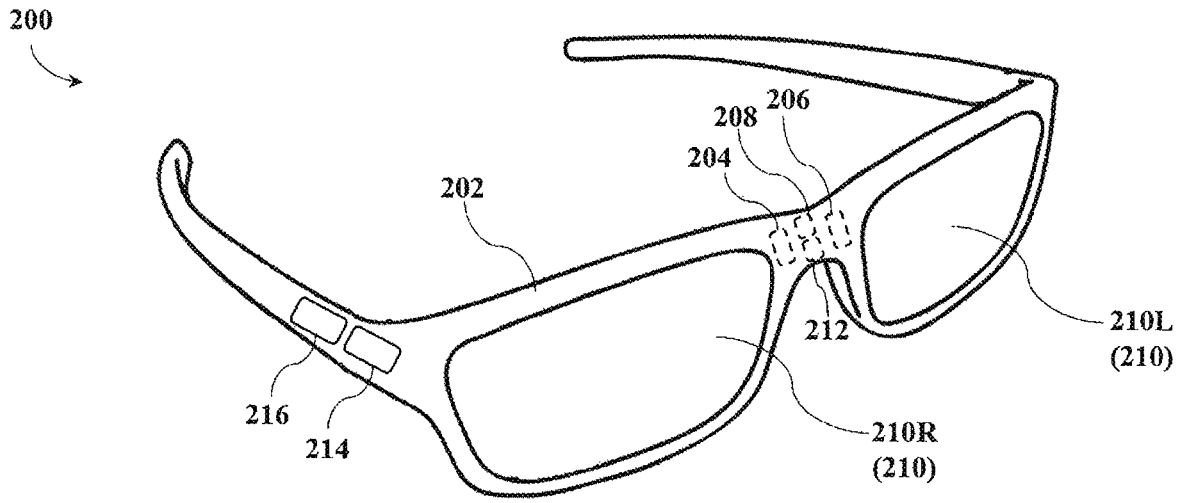
FIG. 21 illustrates an outside perspective view of an example embodiment of a headset which can be used alone, as part of or in conjunction with the systems and methods described herein.

In an embodiment, the system 10 includes a headset 200. FIG. 21 illustrates an example embodiment of a headset 200 in accordance with the present disclosure. The headset 200 includes a frame 202. In the illustrated embodiment, the frame 202 is formed in the shape of glasses which can be worn by a golfer while using one or more of the floor unit 12, the wall unit 14, the first ball 16, and/or the second ball 18. The frame 202 can also be formed in other shapes and sizes. The headset 200 can be used, for example, to enhance the virtual portion of a golf game played using the system 10 and/or method 100. In an embodiment, the headset 200 displays an image I instead of or in addition to an image I displayed on the wall unit 14.

In the illustrated embodiment, the headset 200 includes a processor 204 and a memory 206. The processor 204 is configured to execute instructions stored on the memory 206 to enable the headset 200 to function in conjunction with the methods discussed herein. The memory 206 can include a non-transitory, computer-readable medium. The processor 204 is further configured to execute instructions received from the control unit 24. The headset 200 can therefore further include a data transmission device 208 configured to communicate with the control unit 24, with other elements of the system 10 discussed herein, and/or with an online central server. The data transmission device 208 can include a data bus, a wireless transceiver, and/or any other data transmission mechanism. The data transmission device 208 can be configured for wired or wireless transmission. The data transmission device 208 can be configured for Bluetooth communication with the control unit 24.

In an embodiment, the headset 200 includes at least one display screen 210. Here, the headset 200 includes a left display screen 210L and a right display screen 210R. As illustrated, the display screens 210L, 210R correspond to the lenses of the glasses frame 202. In the illustrated embodiment, the left display screen 210L corresponds to the golfer's left eye, and the right display screen 210R corresponds to the golfer's right eye. The display screen 210 can also be formed as a continuous display screen which includes both of the left display screen 210L and the right display screen 210R instead of a separate left display screen 210L and right display screen 210R.

In an embodiment, the display screen 210 is at least partially transparent. The display screen 210 is also configured to display a plurality of images of a virtual golf hole GH. In an embodiment, the display screen 210 is configured to display one or more image I in accordance with the methods discussed herein. The images I are displayed on the inside of the display screen 210 for viewing by a golfer wearing the headset 200. By using a system 10 including a headset 200, a golfer can further enhance the experience of playing a virtual golf hole GH in accordance with the method 100 discussed herein.

Figure 22A:
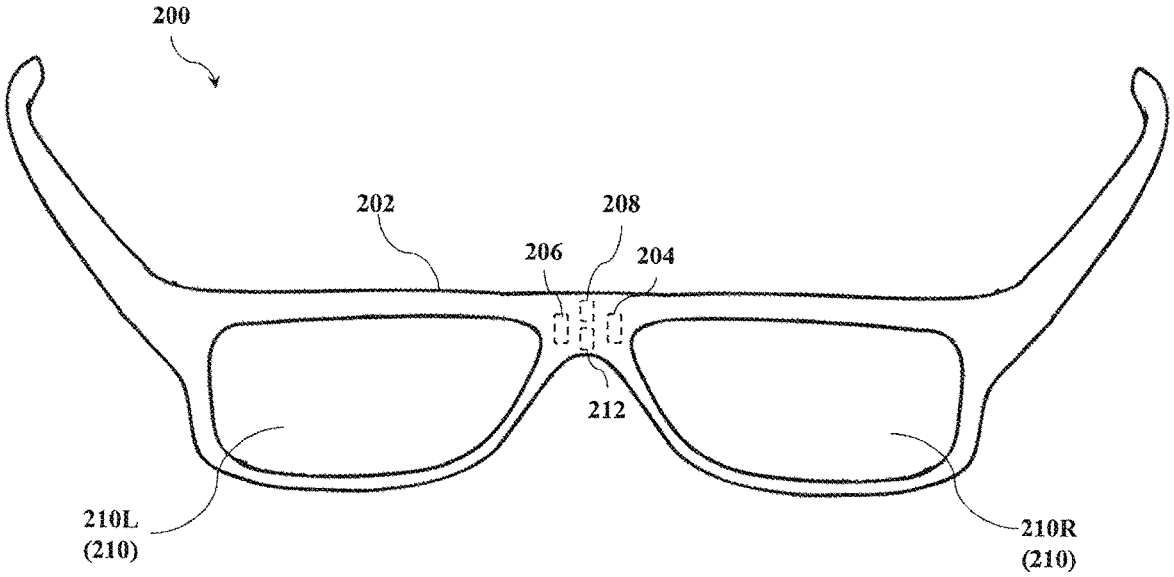
FIGS. 22A and 22B illustrate an inside view of the headset of FIG. 21 from the perspective of a golfer wearing the headset.
Figure 22B:
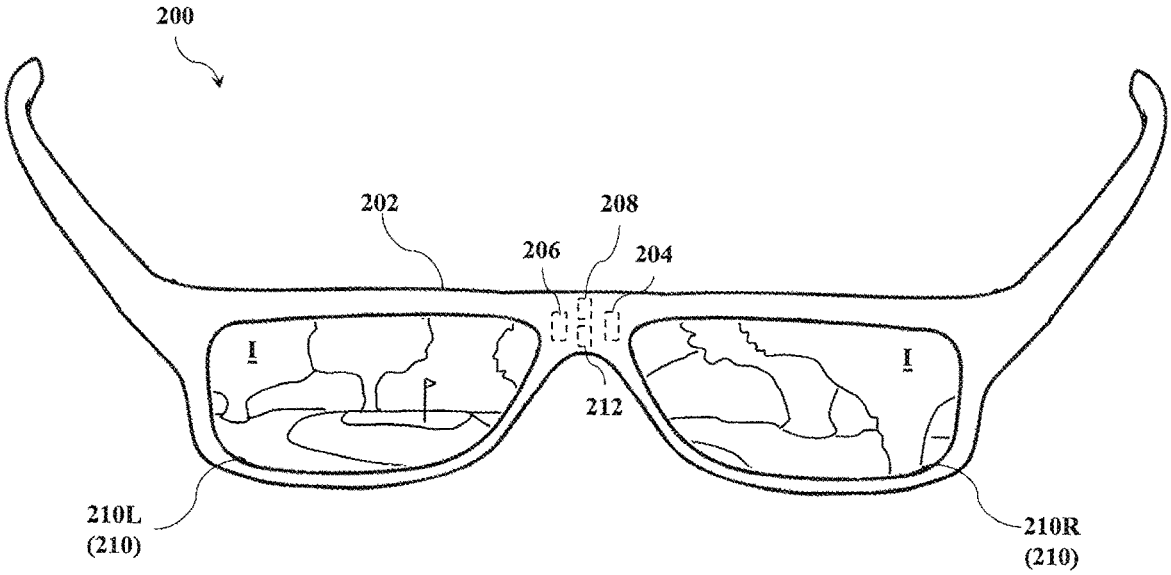

In an embodiment, the headset 200 alternates between a first (e.g., transparent) mode and a second (e.g., virtual) mode. FIG. 22A illustrates the headset 200 from the golfer's perspective while in the transparent mode, while FIG. 22B illustrates the headset 22 from the golfer's perspective while in the virtual mode. In the transparent mode, the display screen 210 is at least partially transparent, for example, so that the golfer can see through the display screen 210 to view one or more of the floor unit 12, the wall unit 14, the first ball 16, and/or the second ball 18. In the virtual mode, the golfer is provided with a 360-degree view of the scenery of a virtual golf hole GH from one or more of a plurality of locations of the virtual golf hole GH. Thus, in the virtual mode, the display screen 210 is configured to display one or more image I in accordance with the methods discussed herein.

In an embodiment, the headset includes a motion sensor 212. The processor 204 is configured to use the motion sensor 212 to determine the orientation and/or directional position of the headset 200. In an embodiment, the motion sensor 212 includes a gyroscope, an accelerometer, and/or another type of sensor. The processor 204 is configured to use the motion sensor 212 to determine whether the golfer is looking downwardly (e.g., vertically, towards his or her feet) or outwardly (e.g., horizontally, towards the wall unit 14). When the processor 204 detects that the golfer is looking downwardly, the processor 204 is configured to cause the headset 200 to be automatically placed in the first (e.g., transparent) mode. This enables the golfer to see the first ball 16 or the second ball 18 when swinging. When the processor 204 detects that the golfer is looking outwardly, the processor 204 is configured to cause the headset 200 to be automatically placed in the second (e.g. virtual) mode. This enables the golfer to look around the virtual golf hole GH before and/or after hitting a shot. This also enables the golfer to watch his or her shot on the virtual golf hole GH after taking a swing. Thus, the headset 200 is configured to be in the transparent mode when the user strikes a first ball 16 and/or a second ball 18, and then to automatically place itself in the virtual mode as the golfer follows through on his or her shot and watches the virtual golf ball travel across the virtual golf hole GH.

In the illustrated embodiment, the headset 200 includes a first button 214 and a second button 216. The first button 214 can be used, for example, to manually alternate between the transparent mode and the virtual mode. The second button 216 can be used, for example, to adjust one or more image I displayed on the display screen 210 during the virtual mode (e.g., zoom in or out, cycle through course information, view the golf hole GH from different perspectives, etc.). It should be understood from this disclosure that the headset 200 can include additional buttons to perform additional functions as well.

In various embodiments, the headset can be used without a floor unit 12 and/or without a wall unit 14. In an embodiment, the headset 200 can be programmed to perform one or more of the steps of method 100 by causing the processor 204 to execute instructions stored on the memory 206. In an embodiment, the headset 200 can be programmed to perform one or more of the steps of method 100 by working in conjunction with the control unit 24. In an embodiment, the control unit 24 can be a separate device from a floor unit 12, allowing the method 100 to be performed without a floor unit 12.

Figure 23A:
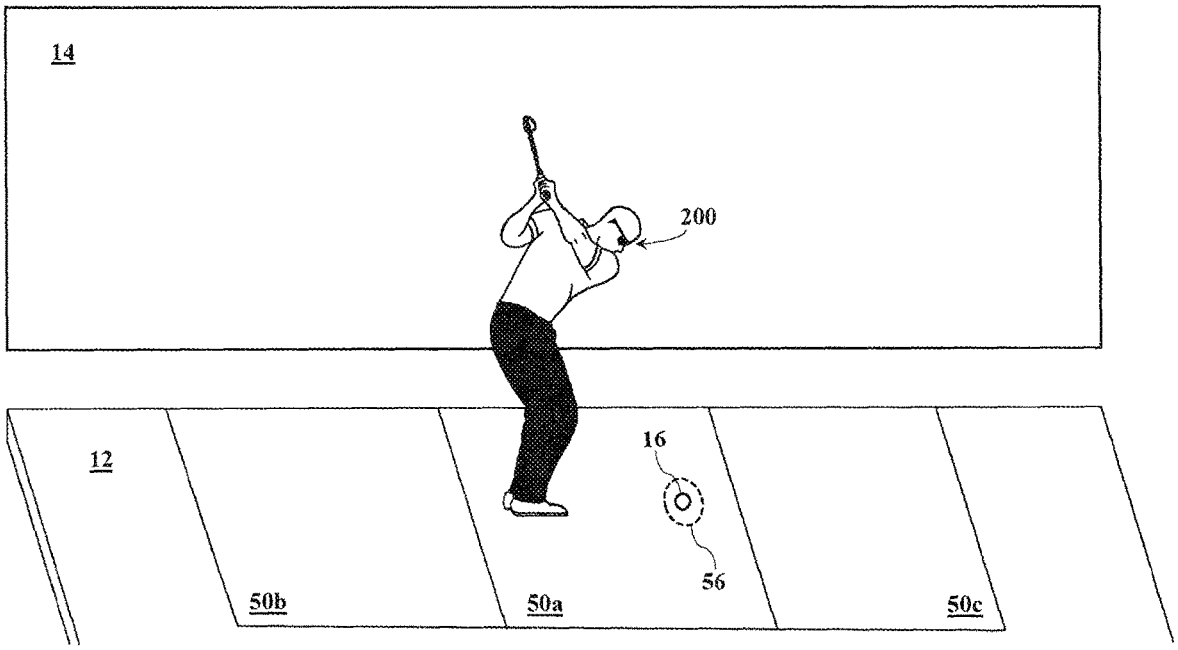
FIGS. 23A and 23B illustrate an example embodiment of a golfer using the headset of FIG. 21 with the system of FIGS. 1 to 5.
Figure 23B:
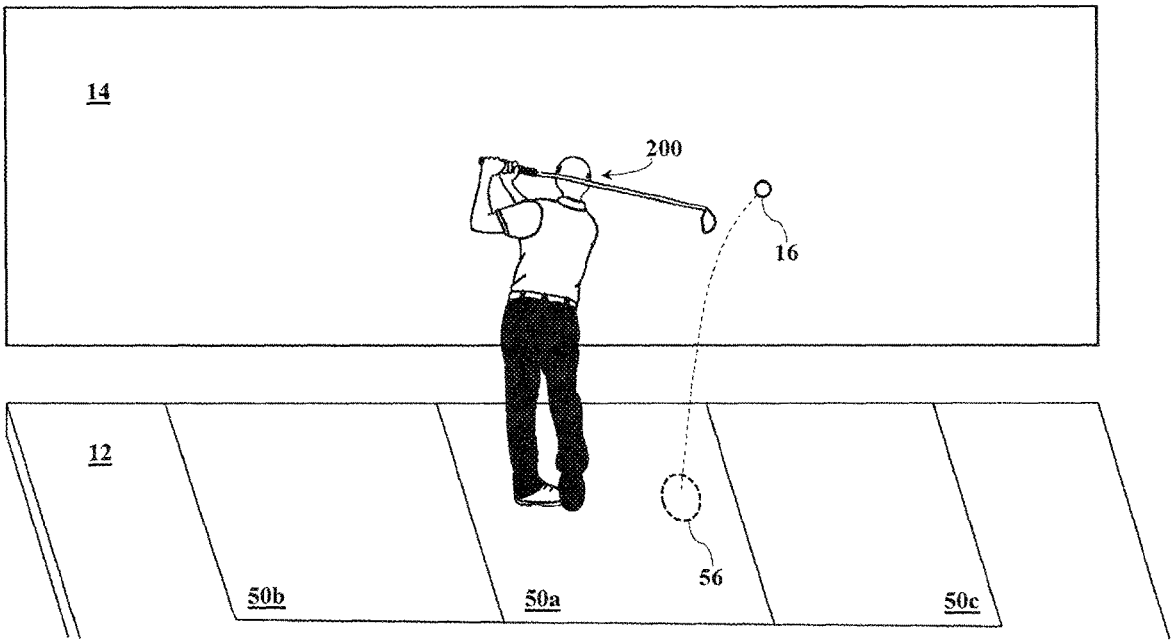

FIGS. 23A and 23B illustrate an example embodiment of a golfer using the headset 200 as part of the system 10. In FIG. 23A, the headset 200 is in the transparent mode as the golfer takes a swing. Here, the golfer is preparing to strike a first ball 16 into the wall unit 14. In an embodiment, the headset 200 automatically places itself in the transparent mode as the golfer looks downwardly at the first ball 16. Then, as the golfer looks up during the follow-through of the swing in FIG. 23B, the headset 200 automatically places itself in the virtual mode so the golfer can watch the virtual ball travel across the virtual golf hole GH. The virtual ball can travel across the virtual golf hole GH in accordance with the flight path determined according to the methods discussed above.

In an embodiment, before the golfer takes a swing in FIG. 23A, the headset 200 is configured to be in the transparent mode or the virtual mode. If the golfer is looking outwardly before taking a swing, then the headset 200 can automatically place itself in the virtual mode so the golfer can look around the virtual golf hole GH and examine the virtual surroundings (e.g., the fairway F, the rough R, the putting green G, the final hole H (e.g., including a flag pole), the sand trap S, the water hazard W, the tree hazard T, the tee box B, etc.). Alternatively, the golfer can use the first button 214 to place the headset in the virtual mode if the golfer wishes to look around and examine the virtual surroundings of the virtual golf hole GH. Then, when the golfer looks down to begin a swing, the headset 200 is configured to automatically place itself in the transparent mode so that the golfer can see the first ball 16 or the second ball 18 (e.g., whichever ball 16, 18 that the golfer is using for the next shot). Alternatively, the golfer can use the first button 214 to place the headset 200 in the transparent mode when the golfer wishes to focus on the first ball 16 or the second ball 18 and take a shot.

In an embodiment, after the golfer takes a shot, the headset 200 is configured to display one or more image I from the location L within the virtual golf hole GH where the last shot landed. Thus, after each shot, the headset 200 can provide the golfer with a 360-degree view of the scenery of the virtual golf hole GH from whatever location L the golfer's virtual golf ball has been calculated to land at within the virtual golf hole GH. In an embodiment, the golfer can walk around near the landing location L, and the headset will adjust the display screen 210 to reflect the surroundings of the virtual golf hole GH (e.g., adjust one or more image I). Thus, the headset enables the golfer to feel like he or she is walking around a real golf hole. Various methods for adjusting such a display screen 210 on the headset 200 are known in the virtual reality and/or augmented reality arts and can be used to implement the 360-degree view of the virtual golf hole GH in accordance with the methods discussed herein.

In an embodiment, the headset 200 is configured to alternate between a striking mode and a putting mode. In an embodiment, the headset 200 can be automatically placed in the striking mode or the putting mode based on instructions from the control unit 24 as to whether the golfer is putting or not putting. In an embodiment, the headset 200 is configured to automatically initiate the striking mode or the putting mode based on the type of ball that the golfer is using. For example, the headset 200 can automatically place itself in the striking mode when the golfer is using a first ball 16. Likewise, the headset 200 can automatically place itself in the putting mode when the golfer is using a second ball 16. In an embodiment, the first button 214 can be used to manually alternate between the striking mode and the putting mode.

In an embodiment, the striking mode operates as shown and discussed above with respect to FIGS. 23A and 23B. More specifically, when in the striking mode, the headset 200 can alternate between the transparent mode and the virtual mode as discussed above. Additionally or alternatively, when in the striking mode, the headset 200 can display information about the golfer's next shot. For example, the display screen 210 can display the calculated distance between the current location L and the final hole H, a club recommendation, the virtual wind speed, the virtual wind direction, and/or any other information about the golfer's next shot (e.g., information or numbers that will be used to calculate the golfer's next virtual shot).

In an embodiment, the putting mode differs from the striking mode in that the headset 200 does not automatically alternate between the transparent mode and the virtual mode based on the golfer's viewing direction when in the putting mode. Since the golfer is putting into a physical hole when the headset 200 is in the putting mode, the putting mode remains in the transparent mode as the golfer lifts his or her head so that the golfer can watch the physical put. In an embodiment, the golfer can use the first button 214 to alternate between the transparent mode and the virtual mode while in the putting mode. Thus, in an embodiment, the headset 200 automatically alternates between the transparent mode and the virtual mode when in the striking mode, but requires manual use of the first button 214 to alternate between the transparent mode and the virtual mode when in the putting mode. Alternatively, the headset 200 can also automatically alternate between the transparent mode and the virtual mode as described above when in the putting mode.

In an embodiment, the putting mode can also differ from the striking mode in that different types of information are displayed on the display screen 210 during the putting mode. For example, the display screen 210 can display information about the putting green G, the distance that must be physically putted by the golfer to the hole 76, the contour of the putting green surface 51, and/or any other information about the golfer's next shot. In an embodiment, the display screen 210 can display the putting green surface contour to the golfer, for example, by displaying a grid showing the rises and dips in the putting green surface 51 using virtual and/or augmented reality.

Figure 24:
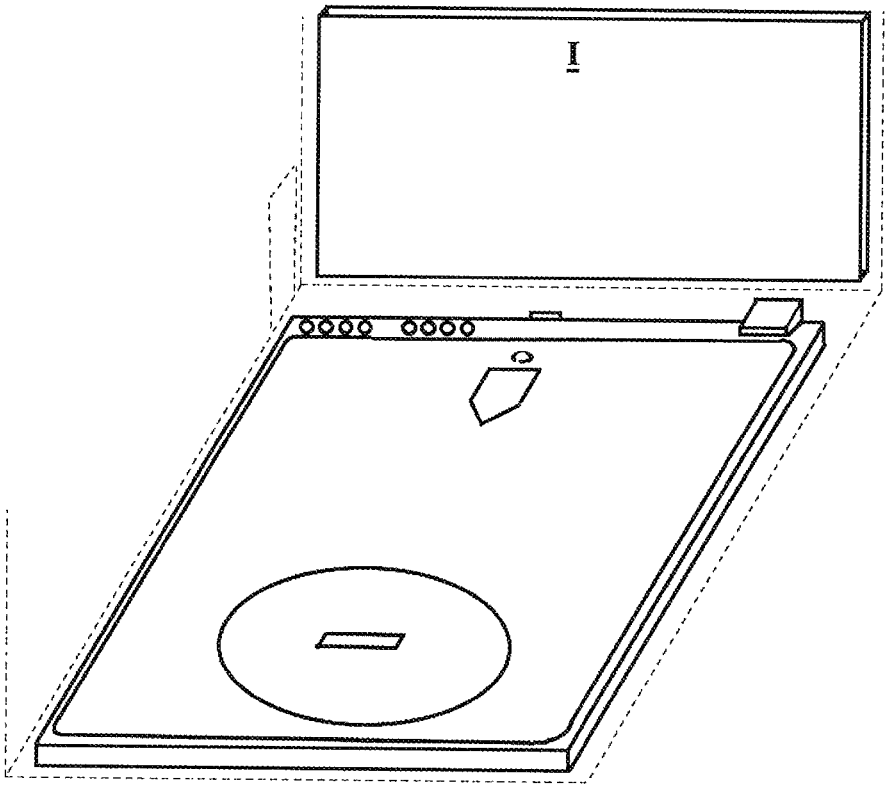
FIG. 24 illustrates an example embodiment of the systems and methods described herein being applied to another sport (e.g., baseball).

It is envisioned that the systems and methods described herein can also be applied to other sports besides golf. FIG. 24 illustrates an example embodiment of the systems and methods described herein applied to baseball. Other sports include, e.g., basketball, football (American or European style), volleyball, softball, dodgeball, handball, racquetball, paddleball, hockey, tennis, or others.

General Interpretation of the Terms

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "configured" as used herein to describe a component, section or part of a device includes hardware and/or software that is constructed and/or programmed to carry out the desired function.

The term "processor" as used herein can refer to one or more processors, such as one or more special purpose processors, one or more digital signal processors, one or more microprocessors, and/or one or more other processors as known in the art.

The term "memory" as used herein can refer to any computer useable or computer readable medium or device that can contain, store, communicate, or transport any signal or information that can be used with any processor. For example, a memory can include one or more read only memory (ROM), random access memory (RAM), one or more other memory, and/or combinations thereof.

While only selected embodiments have been chosen to illustrate the present disclosure, it will be apparent to those skilled in the art from this disclosure that various changes and modifications can be made herein without departing from the scope of the present disclosure. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

Aspects of the Disclosure

Aspects of the subject matter described herein may be useful alone or in combination with any one or more of other aspect described herein. Without limiting the foregoing description, in a first aspect of the present disclosure, a system for playing a golf game within limited confines includes a wall unit configured to display a virtual portion of the golf game, a floor unit configured to enable a physical portion of the golf game, and a control unit programmed to use first data related the virtual portion and second data related to the physical portion to enable a golfer to play a full golf hole.

In accordance with a second aspect of the present disclosure, which may be used in combination with any other aspect or combination of aspects listed herein, the first data includes course data.

In accordance with a third aspect of the present disclosure, which may be used in combination with any other aspect or combination of aspects listed herein, the second data includes ball data.

In accordance with a fourth aspect of the present disclosure, which may be used in combination with any other aspect or combination of aspects listed herein, the second data includes unit data.

In accordance with a fifth aspect of the present disclosure, which may be used in combination with any other aspect or combination of aspects listed herein, the system includes a first ball and a second ball, the first ball configured to be hit by the golfer from the floor unit into the wall unit, the second ball configured to be putted by the golfer on the floor unit.

In accordance with a sixth aspect of the present disclosure, which may be used in combination with any other aspect or combination of aspects listed herein, the first ball differs in weight and/or density in comparison to the second ball.

In accordance with a seventh aspect of the present disclosure, which may be used in combination with any other aspect or combination of aspects listed herein, the first ball is configured to be lighter and/or softer than a real golf ball, and the second ball is configured to have the look and feel of a real golf ball.

In accordance with an eighth aspect of the present disclosure, which may be used in combination with any other aspect or combination of aspects listed herein, at least one of the first ball or the second ball includes a proximity sensor which can be detected by one or more transceiver located in the floor unit or the wall unit.

In accordance with a ninth aspect of the present disclosure, which may be used in combination with any other aspect or combination of aspects listed herein, the first ball includes a spin sensor configured to measure a spin rate of the first ball when the first ball is hit by the golfer from the floor unit into the wall unit.

In accordance with a tenth aspect of the present disclosure, which may be used in combination with any other aspect or combination of aspects listed herein, the first ball includes a speed sensor configured to measure the speed and/or acceleration of the first ball when the first ball is hit by the golfer from the floor unit into the wall unit.

In accordance with an eleventh aspect of the present disclosure, which may be used in combination with any other aspect or combination of aspects listed herein, the second ball includes a speed sensor configured to measure the speed and/or acceleration of the second ball when the second ball is putted by the golfer on the floor unit.

In accordance with a twelfth aspect of the present disclosure, which may be used in combination with any other aspect or combination of aspects listed herein, at least one of the first ball or the second ball includes a light.

In accordance with a thirteenth aspect of the present disclosure, which may be used in combination with any other aspect or combination of aspects listed herein, at least one of the first ball or the second ball includes a transceiver.

In accordance with a fourteenth aspect of the present disclosure, which may be used in combination with any other aspect or combination of aspects listed herein, at least one of the first ball or the second ball includes a battery.

In accordance with a fifteenth aspect of the present disclosure, which may be used in combination with any other aspect or combination of aspects listed herein, the floor unit includes a plurality of different hitting surfaces.

In accordance with a sixteenth aspect of the present disclosure, which may be used in combination with any other aspect or combination of aspects listed herein, the plurality of different hitting surfaces includes at least two of: (i) a fairway hitting surface; (ii) a rough hitting surface; and (iii) a sand hitting surface.

In accordance with a seventeenth aspect of the present disclosure, which may be used in combination with any other aspect or combination of aspects listed herein, the full golf hole is from tee shot to final putt.

In accordance with an eighteenth aspect of the present disclosure, which may be used in combination with any other aspect or combination of aspects listed herein, the floor unit includes a putting green surface which enables the golfer to physically putt a final one or more shot of the golf hole.

In accordance with a nineteenth aspect of the present disclosure, which may be used in combination with any other aspect or combination of aspects listed herein, the floor unit includes a plurality of putting green surface adjusters configured to adjust the surface contour of the putting green surface.

In accordance with a twentieth aspect of the present disclosure, which may be used in combination with any other aspect or combination of aspects listed herein, the control unit controls the putting green surface adjusters based on a virtual landing location of the golfer's ball during the virtual portion of the golf game.

In accordance with a twenty-first aspect of the present disclosure, which may be used in combination with any other aspect or combination of aspects listed herein, the control unit is programmed to apply weights to second data.

In accordance with a twenty-second aspect of the present disclosure, which may be used in combination with any other aspect or combination of aspects listed herein, the control unit is programmed to determine the weights during a calibration process in which the user hits at least one ball from the floor unit into the wall unit.

In accordance with a twenty-third aspect of the present disclosure, which may be used in combination with any other aspect or combination of aspects listed herein, the control unit is programmed to calculate a flight path of a ball hit by the golfer from the floor unit into the wall unit.

In accordance with a twenty-third aspect of the present disclosure, which may be used in combination with any other aspect or combination of aspects listed herein, the control unit is programmed to calculate a flight path of a ball hit by the golfer from the floor unit into the wall unit.

In accordance with a twenty-fourth aspect of the present disclosure, which may be used in combination with any other aspect or combination of aspects listed herein, the control unit is programmed to calculate the flight path of the ball using ball data from a sensor located within the ball.

In accordance with a twenty-fifth aspect of the present disclosure, which may be used in combination with any other aspect or combination of aspects listed herein, the control unit is programmed to calculate the flight path of the ball using unit data from a sensor located within the floor unit or the wall unit.

In accordance with a twenty-sixth aspect of the present disclosure, which may be used in combination with any other aspect or combination of aspects listed herein, the control unit is programmed to calculate the flight path of the ball using course data relating to a generated virtual golf hole.

In accordance with a twenty-seventh aspect of the present disclosure, which may be used in combination with any other aspect or combination of aspects listed herein, the control unit is programmed to calculate the flight path of the ball by calculating at least one of: (i) flight distance; (ii) flight angle; or (iii) curve.

In accordance with a twenty-eighth aspect of the present disclosure, which may be used in combination with any other aspect or combination of aspects listed herein, the control unit is programmed to instruct the golfer where to physically place the ball on the floor unit for a next shot based on the calculated flight path.

In accordance with a twenty-ninth aspect of the present disclosure, which may be used in combination with any other aspect or combination of aspects listed herein, the control unit is programmed to instruct the golfer which of a plurality of balls to use for a next shot based on the calculated flight path.

In accordance with a thirtieth aspect of the present disclosure, which may be used in combination with any other aspect or combination of aspects listed herein, the floor unit includes a putting green surface, and the control unit is programmed to adjust the putting green surface based on the calculated flight path.

In accordance with a thirty-first aspect of the present disclosure, which may be used in combination with any other aspect or combination of aspects listed herein, the control unit is programmed to adjust the putting green surface based on a ball landing location determined using the calculated flight path.

In accordance with a thirty-second aspect of the present disclosure, which may be used in combination with any other aspect or combination of aspects listed herein, the control unit is programmed to adjust a surface contour of the putting green surface.

In accordance with a thirty-third aspect of the present disclosure, which may be used in combination with any other aspect or combination of aspects listed herein, the control unit include a user interface.

In accordance with a thirty-fourth aspect of the present disclosure, which may be used in combination with any other aspect or combination of aspects listed herein, the user interface translated between an extended configuration in which the golfer can use the user interface, and a retracted configuration in which the golfer can play the golf game.

In accordance with a thirty-fifth aspect of the present disclosure, which may be used in combination with any other aspect or combination of aspects listed herein, a system for playing a golf game within limited confine includes a wall unit configured to display a virtual portion of the golf game, a floor unit configured to enable a physical portion of the golf game, a first ball configured to be hit by the golfer from the floor unit into the wall unit, and a second ball configured to be putted by the golfer on the floor unit.

In accordance with a thirty-sixth aspect of the present disclosure, which may be used in combination with any other aspect or combination of aspects listed herein, the first ball differs in weight and/or density in comparison to the second ball.

In accordance with a thirty-seventh aspect of the present disclosure, which may be used in combination with any other aspect or combination of aspects listed herein, the first ball is configured to be lighter and/or softer than a real golf ball, and the second ball is configured to have the look and feel of a real golf ball.

In accordance with a thirty-eighth aspect of the present disclosure, which may be used in combination with any other aspect or combination of aspects listed herein, at least one of the first ball or the second ball includes a proximity sensor which can be detected by one or more transceiver located in the floor unit or the wall unit.

In accordance with a thirty-ninth aspect of the present disclosure, which may be used in combination with any other aspect or combination of aspects listed herein, the first ball includes a spin sensor configured to measure a spin rate of the first ball when the first ball is hit by the golfer from the floor unit into the wall unit.

In accordance with a fortieth aspect of the present disclosure, which may be used in combination with any other aspect or combination of aspects listed herein, the first ball includes a speed sensor configured to measure the speed and/or acceleration of the first ball when the first ball is hit by the golfer from the floor unit into the wall unit.

In accordance with a forty-first aspect of the present disclosure, which may be used in combination with any other aspect or combination of aspects listed herein, the second ball includes a speed sensor configured to measure the speed and/or acceleration of the second ball when the second ball is putted by the golfer on the floor unit.

In accordance with a forty-second aspect of the present disclosure, which may be used in combination with any other aspect or combination of aspects listed herein, at least one of the first ball or the second ball includes a light.

In accordance with a forty-third aspect of the present disclosure, which may be used in combination with any other aspect or combination of aspects listed herein, at least one of the first ball or the second ball includes a transceiver.

In accordance with a forty-fourth aspect of the present disclosure, which may be used in combination with any other aspect or combination of aspects listed herein, at least one of the first ball or the second ball includes a battery.

In accordance with a forty-fifth aspect of the present disclosure, which may be used in combination with any other aspect or combination of aspects listed herein, the system includes a control unit programmed to use first data related the virtual portion and second data related to the physical portion to enable a golfer to play a full golf hole.

In accordance with a forty-sixth aspect of the present disclosure, which may be used in combination with any other aspect or combination of aspects listed herein, the system includes a control unit programmed to calculate a flight path of a first ball hit by the golfer from the floor unit into the wall unit using ball data from a sensor located within the first ball.

In accordance with a forty-seventh aspect of the present disclosure, which may be used in combination with any other aspect or combination of aspects listed herein, a method for playing a golf game within limited confines includes generating a virtual golf hole, calculating a flight path of at least one ball physically hit by the golfer during a first shot related to the virtual golf hole, and instructing the golfer where to place the at least one ball for a second shot related to the virtual golf hole.

In accordance with a forty-eighth aspect of the present disclosure, which may be used in combination with any other aspect or combination of aspects listed herein, a system includes a control unit programmed to perform the method for playing the golf game within limited confines.

In accordance with a forty-ninth aspect of the present disclosure, which may be used in combination with any other aspect or combination of aspects listed herein, a method for playing a golf game within limited confines includes generating a virtual golf hole, calculating a landing location related to the virtual golf hole based on of a first shot physically hit by the golfer, and adjusting a putting green surface based on a landing location so that the golfer can physically hit a second shot using the putting green surface.

In accordance with a fiftieth aspect of the present disclosure, which may be used in combination with any other aspect or combination of aspects listed herein, a system includes a control unit programmed to perform the method for playing the golf game within limited confines.

In accordance with a fifty-first aspect of the present disclosure, which may be used in combination with any other aspect or combination of aspects listed herein, a method for playing a golf game within limited confines includes generating a virtual golf hole, after a golfer physically hits a first ball from a floor unit into a wall unit, calculating a landing location related to the virtual golf hole, and adjusting the floor unit for use with a second ball, which is different from the first ball, based on the landing location.

In accordance with a fifty-second aspect of the present disclosure, which may be used in combination with any other aspect or combination of aspects listed herein, a system includes a control unit programmed to perform the method for playing the golf game within limited confines.

In accordance with a fifty-third aspect of the present disclosure, which may be used in combination with any other aspect or combination of aspects listed herein, a floor unit for playing a golf game within limited confines includes a hitting portion including at least one hitting surface, a putting portion including a putting green surface, and a control portion configured to adjust the putting green surface.

In accordance with a fifty-fourth aspect of the present disclosure, which may be used in combination with any other aspect or combination of aspects listed herein, the hitting portion includes at least one of: (i) a fairway hitting surface; (ii) a rough hitting surface; and (iii) a sand hitting surface.

In accordance with a fifty-fifth aspect of the present disclosure, which may be used in combination with any other aspect or combination of aspects listed herein, the putting portion includes a plurality of putting green surface adjusters configured to adjust a surface contour of the putting green surface.

In accordance with a fifty-sixth aspect of the present disclosure, which may be used in combination with any other aspect or combination of aspects listed herein, the control portion includes a control unit programmed to control the plurality of putting green surface adjusters configured to adjust the surface contour of the putting green surface.

In accordance with a fifty-seventh aspect of the present disclosure, which may be used in combination with any other aspect or combination of aspects listed herein, at least one of the hitting portion or the putting portion includes a transceiver configured to receive a signal from a golf ball configured for use with the floor unit.

In accordance with a fifty-eighth aspect of the present disclosure, which may be used in combination with any other aspect or combination of aspects listed herein, a wall unit for playing a golf game within limited confines includes a display portion configured to display a virtual portion of the golf game, and a sensor portion configured to generate data related to a physical portion of the golf game, the generated data being used to adjust display of the virtual portion.

In accordance with a fifty-ninth aspect of the present disclosure, which may be used in combination with any other aspect or combination of aspects listed herein, the sensor portion includes a plurality of sensors, the plurality of sensors including at least one of a proximity sensor or an impact sensor.

In accordance with a sixtieth aspect of the present disclosure, which may be used in combination with any other aspect or combination of aspects listed herein, a putting green surface adjuster configured to adjust a surface contour of a putting green surface in combination other putting green surface adjusters includes a base portion configured to adjust in height, and a surface supporting portion configured to support the putting green surface, the surface supporting portion further configured to rotate and/or tilt with respect to the base portion.

In accordance with a sixty-first aspect of the present disclosure, which may be used in combination with any other aspect or combination of aspects listed herein, the base portion includes a bottom part and a top part, the top part configured to be raised or lowered with respect to the bottom part to adjust the height of the base portion.

In accordance with a sixty-second aspect of the present disclosure, which may be used in combination with any other aspect or combination of aspects listed herein, the base portion includes an actuator configured to cause the relative movement of the bottom part and the top part.

In accordance with a sixty-third aspect of the present disclosure, which may be used in combination with any other aspect or combination of aspects listed herein, the putting green surface adjuster includes at least one of a transceiver or a light.

In accordance with a sixty-fourth aspect of the present disclosure, which may be used in combination with any other aspect or combination of aspects listed herein, the putting green surface adjuster includes an electrical contact configured to place at least one electrical element therein in electrical communication with a control unit.

In accordance with a sixty-fifth aspect of the present disclosure, which may be used in combination with any other aspect or combination of aspects listed herein, the surface supporting portion includes an aperture which forms a ball joint with a bulbous portion of the base portion.

In accordance with a sixty-sixth aspect of the present disclosure, which may be used in combination with any other aspect or combination of aspects listed herein, a control unit is programmed to control the putting green surface adjuster to adjust the surface contour of a putting green surface.

In accordance with a sixty-seventh aspect of the present disclosure, which may be used in combination with any other aspect or combination of aspects listed herein, a control unit is programmed to control a plurality of the putting green surface adjusters to adjust the surface contour of a putting green surface.

In accordance with a sixty-eighth aspect of the present disclosure, which may be used in combination with any other aspect or combination of aspects listed herein, a control unit is programmed to detect the presence of a golf ball on a floor unit, and to use data regarding the location of the golf ball to calculate a landing location for the golf ball on a virtual golf hole.

In accordance with a sixty-ninth aspect of the present disclosure, which may be used in combination with any other aspect or combination of aspects listed herein, a golf ball includes a sensor configured for use with the system.

In accordance with a seventieth aspect of the present disclosure, which may be used in combination with any other aspect or combination of aspects listed herein, a set of golf balls is configured for use with the system, the set of golf balls including a first golf ball and a second golf ball, the first ball different from the second ball.

In accordance with a seventy-first aspect of the present disclosure, which may be used in combination with any other aspect or combination of aspects listed herein, a headset configured for playing a golf game within limited confines includes a frame configured to be positioned on a golfer's head, and at least one display screen configured to display a virtual portion of the golf game to the golfer while the golfer plays a physical portion of the golf game.

In accordance with a seventy-second aspect of the present disclosure, which may be used in combination with any other aspect or combination of aspects listed herein, the headset includes a processor and a memory, and the processor is configured to execute instructions stored on the memory to cause the virtual portion of the golf game.

In accordance with a seventy-third aspect of the present disclosure, which may be used in combination with any other aspect or combination of aspects listed herein, the headset includes a data transmission device configured to receive information regarding the virtual portion of the golf game.

In accordance with a seventy-fourth aspect of the present disclosure, which may be used in combination with any other aspect or combination of aspects listed herein, the headset is configured to alternate between a transparent mode and a virtual mode.

In accordance with a seventy-fifth aspect of the present disclosure, which may be used in combination with any other aspect or combination of aspects listed herein, the headset includes a motion sensor, and the headset is configured to alternate between the transparent mode and the virtual mode based on information from the motion sensor.

In accordance with a seventy-sixth aspect of the present disclosure, which may be used in combination with any other aspect or combination of aspects listed herein, the headset is configured to alternate between a striking mode and a putting mode.

In accordance with a seventy-seventh aspect of the present disclosure, which may be used in combination with any other aspect or combination of aspects listed herein, a system in accordance with a previous embodiment includes a headset configured to display at least one image related to the virtual portion of the golf game.

In accordance with a seventy-eighth aspect of the present disclosure, which may be used in combination with any other aspect or combination of aspects listed herein, a system in accordance with a previous embodiment includes a headset configured to display at least one image related to the virtual portion of the golf game.

In accordance with a seventy-ninth aspect of the present disclosure, which may be used in combination with any other aspect or combination of aspects listed herein, a method in accordance with a previous embodiment includes adjusting at least one image of the virtual golf hole on a display screen of a headset.

In accordance with an eightieth aspect of the present disclosure, which may be used in combination with any other aspect or combination of aspects listed herein, a method in accordance with a previous embodiment includes adjusting at least one image of the virtual golf hole on a display screen of a headset.

In accordance with an eighty-first aspect of the present disclosure, which may be used in combination with any other aspect or combination of aspects listed herein, a method in accordance with a previous embodiment includes adjusting at least one image of the virtual golf hole on a display screen of a headset.

In accordance with an eighty-second aspect of the present disclosure, which may be used in combination with any other aspect or combination of aspects listed herein, a system for playing a golf game within limited confines includes a floor unit in accordance with a pervious embodiment and a headset in communication with the floor unit, the headset including a display screen configured to display at least one image while a golfer physically uses the floor unit.

In accordance with an eighty-third aspect of the present disclosure, which may be used in combination with any other aspect or combination of aspects listed herein, a system for playing a golf game within limited confines includes a wall unit in accordance with a pervious embodiment and a headset in communication with the wall unit, the headset including a display screen configured to display at least one image related to the virtual portion of the golf game.

In accordance with an eighty-fourth aspect of the present disclosure, which may be used in combination with any other aspect or combination of aspects listed herein, a system for playing a sport within limited confines includes a wall unit configured to display a virtual portion of the sport, a floor unit configured to enable a physical portion of the sport, and a control unit programmed to use first data related the virtual portion and second data related to the physical portion to enable a user to play the sport.

In accordance with an eighty-fifth aspect of the present disclosure, which may be used in combination with any other aspect or combination of aspects listed herein, the sport is golf, baseball, basketball, football (American or European style), volleyball, softball, dodgeball, handball, racquetball, paddleball, hockey, tennis, or another sport.

What is claimed is:

1. A headset for a golf game that combines a virtual portion and a physical portion, the headset comprising:

a frame configured to be positioned on a golfer's head, the frame including at least one lens; and at least one display screen corresponding to the at least one lens, the at least one display screen configured to display the virtual portion of the golf game to the golfer while the golfer plays the physical portion of the golf game, the headset configured to instruct the golfer where to place a golf ball for a next shot by displaying an image on the at least one display screen corresponding to the at least one lens.

2. The headset of claim 1, wherein the at least one display screen is at least partially transparent.

3. The headset of claim 1, which is configured to alternate between a transparent mode and a virtual mode.

4. The headset of claim 3, which is configured to automatically place itself in the virtual mode as the golfer follows through on a physical shot to enable the golfer to watch a virtual golf ball travel across a virtual golf hole via the at least one display screen.

5. The headset of claim 1, wherein the at least one display screen provides the golfer a 360 degree view of a virtual golf hole.

6. The headset of claim 5, wherein the 360 degree view of the virtual golf hole is from a point of reference where a virtual golf ball landed on the virtual golf hole.

7. The headset of claim 1, wherein the at least one display screen is configured to display course information relating to a virtual golf hole.

8. The headset of claim 1, wherein the at least one display screen includes a left display screen corresponding to one of the golfer's eyes and a right display screen corresponding to the other of the golfer's eyes.

9. The headset of claim 1, which includes a processor configured to cause the virtual portion of the golf game to be displayed on the at least one display screen.

10. The headset of claim 1, which includes a data transmission device configured to be placed in communication with a physical system for playing the physical portion of the golf game.

11. The headset of claim 1, wherein the headset is configured to instruct the golfer where to place the golf ball for the next shot by displaying the image of a ball or location on the at least one display screen.

12. A headset for a golf game that combines a virtual portion and a physical portion, the headset comprising:

a frame configured to be positioned on a golfer's head, the frame including at least one lens;

at least one display screen corresponding to the at least one lens, the at least one display screen configured to display the virtual portion of the golf game to the golfer while the golfer plays the physical portion of the golf game; and a motion sensor configured to determine an orientation or directional position of the headset, the at least one display screen configured to alternate between different modes based on information from the motion sensor regarding the orientation or directional position of the headset.

13. The headset of claim 12, which is configured to use the motion sensor to place the at least one display screen in a transparent mode when the golfer is looking downwardly and in a virtual mode when the golfer is looking outwardly.

14. The headset of claim 12, wherein the motion sensor includes one or both of a gyroscope or an accelerometer.

15. The headset of claim 12, wherein the at least one display screen is configured to alternate between a transparent mode and a virtual mode based on information from the motion sensor regarding the orientation or directional position of the headset.

16. The headset of claim 12, comprising at least one button configured to further cause the at least one display screen to alternate between the different modes.

17. A headset for a golf game that combines a virtual portion and a physical portion, the headset comprising:

a frame configured to be positioned on a golfer's head, the frame including at least one lens; and at least one display screen corresponding to the at least one lens, the at least one display screen configured to display the virtual portion of the golf game to the golfer while the golfer plays the physical portion of the golf game, the at least one display screen configured to alternate between a striking mode and a putting mode based on instructions from a control unit as to whether the golfer is putting or not putting.

18. The headset of claim 17, wherein the at least one display screen displays different types of information when in the striking mode and the putting mode.

19. The headset of claim 18, wherein the at least one display screen displays at least one of a distance that must be physically putted by the golfer or a contour of a putting green surface when in the putting mode.

20. The headset of claim 17, wherein the headset is configured to automatically initiate the striking mode or the putting mode based on a type of ball that the golfer is using.

* * * * *